US008440947B2

(12) United States Patent
Fitzwater

(10) Patent No.: US 8,440,947 B2
(45) **Date of Patent: *May 14, 2013**

(54) MICROWAVE HEATING PACKAGE WITH REMOVABLE PORTION

(75) Inventor: Kelly R. Fitzwater, Lakewood, CO (US)

(73) Assignee: Graphic Packaging International, Inc., Marietta, GA (US)

( * ) Notice: Subject to any disclaimer, the term of this patent is extended or adjusted under 35 U.S.C. 154(b) by 52 days.

This patent is subject to a terminal disclaimer.

(21) Appl. No.: 13/046,901

(22) Filed: Mar. 14, 2011

(65) Prior Publication Data

US 2011/0163090 A1 Jul. 7, 2011

Related U.S. Application Data

(62) Division of application No. 11/567,364, filed on Dec. 6, 2006, now Pat. No. 7,928, 349.

(60) Provisional application No. 60/748,638, filed on Dec. 8, 2005.

(51) Int. Cl.
*H05B 6/80* (2006.01)
*B65D 5/54* (2006.01)
*B65D 43/00* (2006.01)

(52) U.S. Cl.
USPC ..... 219/730; 219/725; 426/109; 426/234; 229/128; 229/242; 229/903

(58) Field of Classification Search ..... 219/725–735, 219/759, 762; 99/DIG. 14; 426/107, 109, 426/113, 234, 243, 241; 229/101.1, 242, 229/128, 903, 938
See application file for complete search history.

(56) References Cited

U.S. PATENT DOCUMENTS

| | | | |
|---|---|---|---|
| 1,516,090 | A | 11/1924 | Gary et al. |
| 2,132,966 | A | 11/1938 | O'Brien |
| 3,240,419 | A | 3/1966 | Spiering et al. |
| 3,324,998 | A | 6/1967 | Farquhar |
| 3,637,130 | A | 1/1972 | Farquhar |
| 4,228,945 | A | 10/1980 | Wysocki |
| 4,775,771 | A | 10/1988 | Pawlowski |
| 4,865,921 | A | 9/1989 | Hollenberg |

(Continued)

FOREIGN PATENT DOCUMENTS

| | | | |
|---|---|---|---|
| CA | 2 586 472 | A1 | 5/2006 |
| DE | 203 00 817 | U1 | 6/2003 |

(Continued)

OTHER PUBLICATIONS

Notice of Allowance and Issue Fee dated Dec. 29, 2010, U.S. Appl. No. 11/567,364.

(Continued)

*Primary Examiner* — Quang Van
(74) *Attorney, Agent, or Firm* — Womble Carlyle Sandridge & Rice, LLP

(57) ABSTRACT

Various blanks are provided for forming sleeves, containers, and other constructs for heating, browning, and/or crisping of a food item in a microwave oven, and for holding and/or transporting the food item after heating. The various blanks, sleeves, containers, and other constructs include a removable portion defined by one or more lines of disruption that enable the removable portion to be separated from the remainder of the blank, sleeve, container, or other construct.

28 Claims, 19 Drawing Sheets

U.S. PATENT DOCUMENTS

| | | | | |
|---|---|---|---|---|
| 4,890,439 | A | 1/1990 | Smart | |
| 4,919,785 | A | 4/1990 | Willey et al. | |
| 4,936,935 | A | 6/1990 | Beckett | |
| 4,963,424 | A | 10/1990 | Beckett | |
| 5,034,234 | A | 7/1991 | Andreas et al. | |
| 5,039,364 | A | 8/1991 | Beckett et al. | |
| 5,071,062 | A | 12/1991 | Bradley et al. | |
| 5,078,273 | A | 1/1992 | Kuchenbecker | |
| 5,096,723 | A | 3/1992 | Turpin | |
| 5,117,078 | A | 5/1992 | Beckett | |
| 5,175,404 | A | 12/1992 | Andreas et al. | |
| 5,213,902 | A | 5/1993 | Beckett | |
| 5,221,419 | A | 6/1993 | Beckett | |
| 5,260,537 | A | 11/1993 | Beckett | |
| 5,266,386 | A | 11/1993 | Beckett | |
| RE34,683 | E | 8/1994 | Maynard | |
| 5,340,436 | A | 8/1994 | Beckett | |
| 5,354,973 | A | 10/1994 | Beckett | |
| 5,410,135 | A | 4/1995 | Pollart | |
| 5,424,517 | A | 6/1995 | Habeger | |
| 5,484,100 | A | 1/1996 | Rigby | |
| 5,510,132 | A | 4/1996 | Gallo, Jr. | |
| 5,519,195 | A | 5/1996 | Keefer | |
| 5,585,027 | A | 12/1996 | Young | |
| 5,628,921 | A | 5/1997 | Beckett | |
| 5,672,407 | A | 9/1997 | Beckett | |
| 5,688,427 | A | 11/1997 | Gallo, Jr. | |
| 5,759,422 | A | 6/1998 | Schmelzer | |
| 5,800,724 | A | 9/1998 | Habeger | |
| 5,938,110 | A | 8/1999 | Bernstein | |
| 6,063,415 | A | 5/2000 | Walters | |
| 6,114,679 | A | 9/2000 | Lai | |
| 6,150,646 | A | 11/2000 | Lai et al. | |
| 6,204,492 | B1 | 3/2001 | Zeng et al. | |
| 6,251,451 | B1 | 6/2001 | Zeng | |
| 6,414,290 | B1 | 7/2002 | Cole | |
| 6,433,322 | B2 | 8/2002 | Zeng et al. | |
| 6,455,827 | B2 | 9/2002 | Zeng | |
| 6,552,315 | B2 | 4/2003 | Zeng et al. | |
| 6,677,563 | B2 | 1/2004 | Lai | |
| 6,683,289 | B2 | 1/2004 | Whitmore et al. | |
| 6,717,121 | B2 | 4/2004 | Zeng | |
| 6,744,028 | B2 | 6/2004 | Chisholm et al. | |
| 6,765,182 | B2 | 7/2004 | Cole | |
| 7,414,230 | B2 | 8/2008 | Fitzwater | |
| 7,473,875 | B2 | 1/2009 | Fitzwater | |
| 7,667,167 | B2 | 2/2010 | Fitzwater | |
| 7,893,389 | B2 * | 2/2011 | Fitzwater | 219/730 |
| 7,928,349 | B2 | 4/2011 | Fitzwater | |
| 7,982,167 | B2 | 7/2011 | Fitzwater | |
| 8,063,344 | B2 * | 11/2011 | Cole et al. | 219/730 |
| 8,309,896 | B2 | 11/2012 | Fitzwater | |
| 2003/0080120 | A1 | 5/2003 | Whitmore et al. | |
| 2003/0206997 | A1 | 11/2003 | Winkleman et al. | |
| 2004/0101605 | A1 | 5/2004 | Sigel | |
| 2005/0284865 | A1 | 12/2005 | Fogle et al. | |
| 2006/0049190 | A1 | 3/2006 | Middleton | |
| 2006/0096978 | A1 | 5/2006 | Lafferty et al. | |
| 2006/0113300 | A1 | 6/2006 | Wnek et al. | |
| 2007/0131742 | A1 | 6/2007 | Fitzwater | |
| 2007/0131743 | A1 | 6/2007 | Fitzwater | |
| 2007/0131744 | A1 | 6/2007 | Fitzwater | |
| 2007/0131745 | A1 | 6/2007 | Fitzwater | |
| 2007/0138247 | A1 | 6/2007 | Fitzwater | |
| 2008/0308614 | A1 | 12/2008 | Fitzwater | |
| 2009/0039077 | A1 | 2/2009 | Fitzwater | |
| 2010/0193509 | A1 | 8/2010 | Fitzwater | |

FOREIGN PATENT DOCUMENTS

| | | | |
|---|---|---|---|
| EP | 1 452 458 | A2 | 9/2004 |
| FR | 2 516 481 | | 5/1983 |
| FR | 2 665 882 | | 2/1992 |
| FR | 2 687 384 | | 8/1993 |
| GB | 2 365 000 | A | 2/2002 |
| JP | 2004 224402 | A | 8/2004 |
| WO | WO 2006/052326 | A2 | 5/2006 |
| WO | WO 2007/067705 | A2 | 6/2007 |
| WO | WO 2009/023286 | A1 | 2/2009 |

OTHER PUBLICATIONS

Notice of Allowance and Issue Fee dated Mar. 31, 2011, U.S. Appl. No. 11/567,376.

European Search Report dated Sep. 20, 2011 for EP 11 00 5496.

European Search Report dated Sep. 20, 2011 for EP 11 00 5497.

International Search Report and Written Opinion—PCT/US2006/046755, Jun. 27, 2007, Graphic Packaging International, Inc.

International Search Report and Written Opinion—PCT/US2008/050578, May 28, 2008, Graphic Packaging International, Inc.

International Preliminary Report on Patentability—PCT/US2006/046755, Mar. 25, 2008, Graphic Packaging International, Inc.

International Preliminary Report on Patentability—PCT/US2008/050578, Feb. 25, 2010, Graphic Packaging International, Inc.

European Search Report—EP. App. No. 10004338, Jun. 4, 2010, Graphic Packaging International, Inc.

European Search Report—EP App. No. 11005496, Sep. 8, 2011, Graphic Packaging International, Inc.

European Search Report—EP App. No. 11005497, Sep. 8, 2011, Graphic Packaging International, Inc.

European Search Report—EP App. No. 1200441, Aug. 10, 2012, Graphic Packaging International, Inc.

* cited by examiner

MICROWAVE HEATING PACKAGE WITH REMOVABLE PORTION

CROSS-REFERENCE TO RELATED APPLICATIONS

This application is a divisional of U.S. patent application Ser. No. 11/567,364, filed Dec. 6, 2006, which claims the benefit of U.S. Provisional Application No. 60/748,638, filed Dec. 8, 2005, which is incorporated by reference herein it its entirety.

TECHNICAL FIELD

The present invention relates to various blanks, constructs, and methods for heating, browning, and/or crisping a food item, and particularly relates to various blanks, constructs, and methods for heating, browning, and/or crisping a food item in a microwave oven.

BACKGROUND

There is a need for a package or other construct that facilitates transportation and consumption of a food item therein. There further is a need for such a package or other construct that enhances browning and crisping of a food item in a microwave oven.

SUMMARY

The present invention generally is directed to various blanks and sleeves, pouches, packages, and other constructs (collectively "constructs") formed therefrom. The various constructs formed from the blanks include one or more features that allow a consumer to access various portions of the food item therein as the food item is consumed. Additionally, any of the constructs of the invention may include features that enhance the browning and crisping of the food item heated therein.

Numerous blanks are contemplated by the invention. Each blank generally comprises a plurality of adjoined panels, each panel having a first dimension extending in a first direction and a second dimension extending in a second direction, where the first direction is substantially perpendicular to the second direction. The various blanks typically include a pair of opposed surfaces. A microwave energy interactive element may overlie at least a portion of at least one of the opposed surfaces. The microwave energy interactive element may comprise a susceptor, a foil, a segmented foil, or any combination thereof.

Each of the various blanks includes a removable portion defined at least partially by a line of disruption. In one aspect, the removable portion is defined at least partially by a tear line extending in the second direction at least partially across at least one of the adjoined panels. In one variation, the removable portion is a first removable portion, the tear line is a first tear line, the blank further comprises a second removable portion defined at least partially by a second tear line extending in the second direction at least partially across the blank, and the first tear line is substantially parallel to the second tear line.

In another aspect, the removable portion is defined at least partially by an oblique tear line and a transverse tear line extending in the second direction at least partially across at least one of the adjoined panels. In one variation, the removable portion includes a tab and the oblique tear line extends substantially between the tab and the transverse tear line.

In still another aspect, the removable portion is defined at least partially by an oblique tear line in the main panel and a transverse tear line extending in the second direction substantially across the main panel. The oblique tear line extends from a tab proximate a peripheral edge extending in a second direction substantially perpendicular to the first direction. In one variation, the oblique tear line extends substantially between the tab and the transverse tear line. In another variation, the tab is positioned adjacent to a cutout in the blank.

Any of the various blanks may be formed into a sleeve for heating, browning, and/or crisping a food item in a microwave oven, where the sleeve includes a removable portion comprising the removable portion of the blank. The sleeve may comprise a first main panel and a second main panel in an opposed configuration, and a first minor panel and a second minor panel in an opposed configuration. The first main panel, the second main panel, the first minor panel, and the second minor panel are joined to the first main panel and the second main panel along respective fold lines to define at least partially an interior surface. A microwave energy interactive element overlies at least a portion of the interior surface. The microwave energy interactive element may comprise a susceptor, a foil, a segmented foil, or any combination thereof.

The sleeve may include a removable portion comprising at least a portion of at least one of the first main panel, the second main panel, the first minor panel, and the second minor panel. In one aspect, the removable portion is defined at least partially by a line of disruption extending in the second direction across at least a portion of at least one of the first main panel, the second main panel, the first minor panel, and the second minor panel. In another aspect, the removable portion is defined at least partially by an oblique tear line at least partially lying within the first main panel and a transverse tear line extending in the second direction across at least a portion of the first main panel.

If desired, the sleeve may be transformed into a container in which the food item can be positioned in an upright configuration for transportation and/or consumption. The container generally may include a pair of opposed main panels, a pair of opposed minor panels joined to the main panels along respective fold lines, and a pair of end panels collectively defining an interior space. The end panels may be folded toward the interior space in a superposed configuration. The container may be positioned in an upright configuration with the food item being supported by the end panels.

The container includes one or more removable portions that allow a user to reduce the size of, or alter the shape of, the container, thereby gaining better access to the food item. In one aspect, the removable is portion defined at least partially by a line of disruption extending in the second direction across at least a portion of at least one of the first main panel, the second main panel, the first minor panel, and the second minor panel.

In another aspect, the removable portion is defined at least partially by an oblique tear line and a transverse tear line extending in the second direction at least partially across at least one of the adjoined panels. In one variation, the removable portion comprises a tab and the oblique tear line extends substantially between the tab and the transverse tear line. In another variation, the container includes a cutout disposed between the first main panel and the second main panel. In another variation, the container includes a microwave energy interactive element overlying at least a portion of at least one of the first main panel, the second main panel, the first minor panel, and the second minor panel.

Other features, aspects, and embodiments will be apparent from the following description and accompanying figures.

BRIEF DESCRIPTION OF THE DRAWINGS

The description refers to the accompanying drawings, some of which are schematic, in which like reference characters refer to like parts throughout the several views, and in which.

DESCRIPTION

The present invention may be illustrated further by referring to the figures. For purposes of simplicity, like numerals may be used to describe like features. It will be understood that where a plurality of similar features are depicted, not all of such features necessarily are labeled on each figure. It also will be understood that various components used to form the blanks and constructs of the present invention may be interchanged. Thus, while only certain combinations are illustrated herein, numerous other combinations and configurations are contemplated hereby.

Figure 1A:
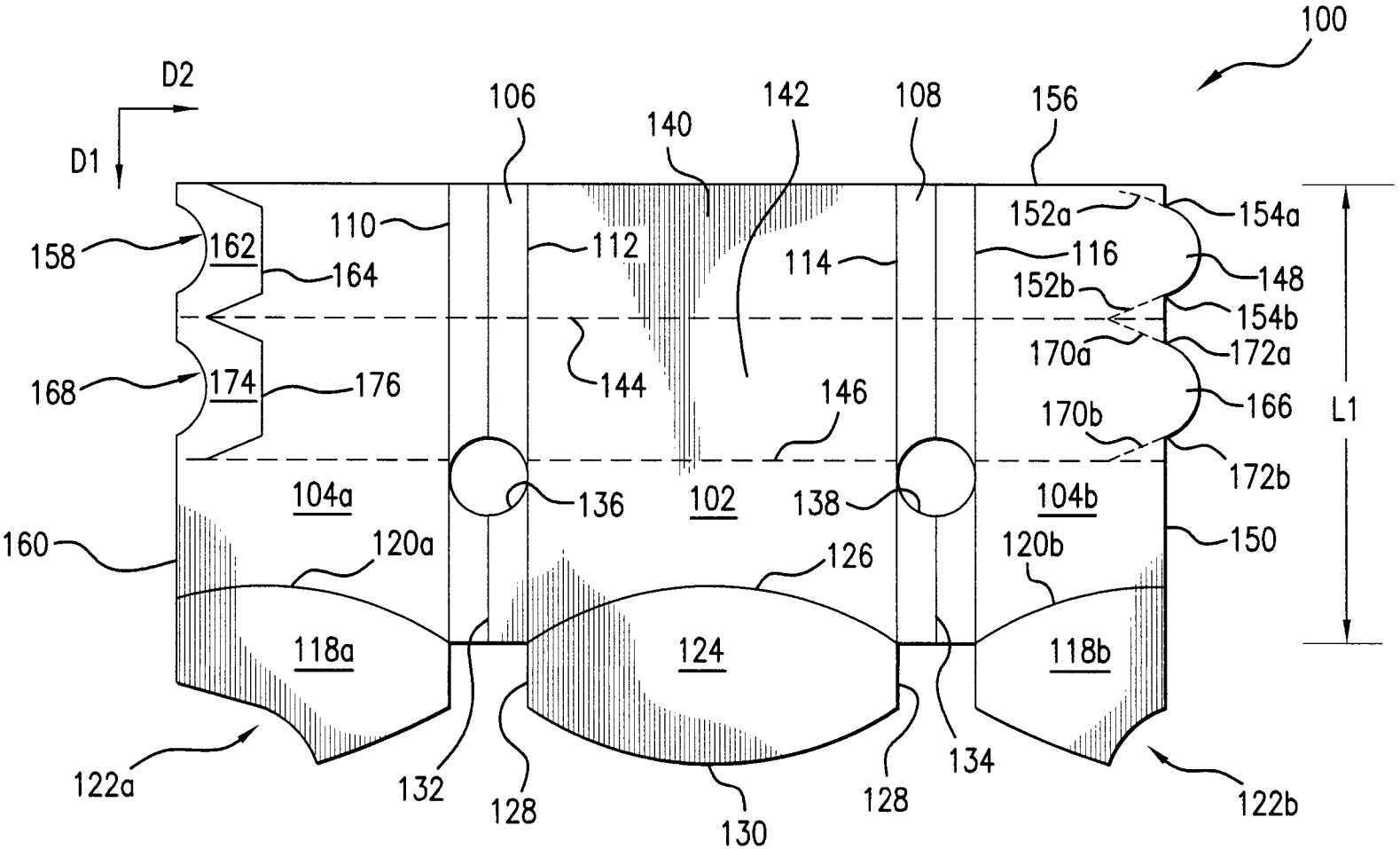
FIG. 1A depicts an exemplary blank according to various aspects of the present invention.

FIG. 1A depicts an exemplary blank 100 according to various aspects of the present invention. The blank 100 includes a plurality of adjoined panels. In this and other aspects of the invention discussed herein and/or contemplated hereby, each of the various panels and the blank generally has a first dimension, for example, a length, extending in a first direction, for example, a longitudinal direction, D1, and a second dimension, for example, a width, extending in a second direction, for example, a transverse direction, D2. It will be understood that such designations are made only for convenience and do not necessarily refer to or limit the manner in which the blank is manufactured or erected into a construct.

The blank 100 generally includes a main panel 102, a first major panel 104*a*, a second major panel 104*b*, a first minor panel 106, and a second minor panel 108. The first minor panel 106 is joined to the first major panel 104*a* along a longitudinal fold line 110. The main panel 102 is joined to the first minor panel 106 along a longitudinal fold line 112. The second minor panel 108 is joined to the main panel 102 along a longitudinal fold line 114. The second major panel 104*b* is joined to the second minor panel 108 along a longitudinal fold line 116. In this example, minor panels 106 and 108 are substantially equal in length, L1. Additionally, fold lines 110, 112, 114, and 116 are substantially parallel and substantially equal in length, L1. However, other lengths and configurations are contemplated hereby.

The blank 100 includes partial end panels 118*a* and 118*b* respectively joined to major panels 104*a* and 104*b* along respective curved fold line segments 120*a* and 120*b*. Each of the partial end panels 118*a* and 118*b* respectively optionally include a partial cutout 122*a* and 122*b*, which may or may not be similar or identical in shape and size.

The blank 100 also includes an end panel 124 joined to the main panel 102 along a substantially arcuate fold line 126. In this example, the end panel 124 is substantially lentiform in shape, generally resembling a biconvex lens including two opposed substantially parallel edges 128, a first, inner arcuate edge defined by fold line 126, and a second, outer arcuate edge 130. However, the end panel 124 may have any suitable shape, for example, square, rectangle, oval, or any other regular or irregular shape.

The first minor panel 106 and the second minor panel 108 each include respective longitudinal fold lines 132 and 134 substantially centrally disposed and extending along the length L1 thereof. Optionally, one or both of the first minor panel 106 and the second minor panel 108 include respective apertures 136 and 138. In the example shown in FIG. 1A, aperture 136 is substantially circular in shape and extends substantially between fold lines 110 and 112. Likewise, aperture 138 is substantially circular in shape and extends substantially between fold lines 114 and 116. However, it will be understood that in this and other aspects of the invention described herein and contemplated hereby, the number, shape, size, and positioning of such apertures may vary for a particular application depending on type of construct being formed from the blank, the food item to be heated therein or thereon, the desired degree of browning and/or crisping, whether direct exposure to microwave energy is needed or desired to attain uniform heating of the food item, the need for regulating the change in temperature of the food item through direct heating, and whether and to what extent there is a need for venting.

Still viewing FIG. 1A, the blank 100 includes a first removable portion 140 and a second removable portion 142 extending in the transverse direction. Each removable portion 140 and 142 includes at least a portion of each of panels 102, 104*a*, 104*b*, 106, and 108. The first removable portion 140 is joined to the second removable portion 142 along a transverse tear line 144. The second removable portion 142 is joined to the remainder of panels 102, 104*a*, and 104*b* along a transverse tear line 146 that, in this example, is interrupted by apertures 136 and 138. It will be understood that while the exemplary blank 100 of FIG. 1A includes two removable portions 140 and 142, any number of such removable portions and any configuration of such removable portions may be used as desired. Additionally, it will be understood that in this and other aspects of the invention, any type of tear line or other line of disruption may be used to define the removable portion. For example, the line of disruption may include a score line, a cut line, a perforated line, kiss cut line, zigzag cut line, a zipper cut line, any other suitable line of disruption, or any combination thereof. Further, in this example, tear line 144 is shown as being substantially parallel to tear line 146. However, other configurations of tear lines are contemplated hereby.

The first removable portion 140 includes an extension or tab 148 that partially defines a peripheral edge 150 extending in the longitudinal direction. In this example, the tab 148 is substantially arcuate in shape. However, it will be understood that the extension may have any shape as needed or desired. For example, the extension may be oval, rectangular, square, diamond-shaped, trapezoidal, polygonal, or any other regular or irregular shape. Tear line 152*a* extends from a first end 154*a* of tab 148 towards, and may abut, edge 156. Tear line 152*b* extends from a second end 154*b* of tab 148 in a direction towards, and may abut, tear line 144. In this example, tear lines 152*a* and 152*b* are positioned relative to tab 148 such that the combination of tear line 152*a*, tab 148, and tear line 152*b* is substantially arcuate in shape. However, it will be understood that such tear lines may have any suitable shape and may or may not correspond to or extend the shape of the tab. Thus, for example, although the tab 148 is substantially arcuate in shape, the tear line segments 152*a* and 152*b* may be parallel lines, zigzags, or any other configuration. Tear lines 152*a* and 152*b* cooperate with tab 148 to facilitate removal of the first removable portion 140, as will be described below.

The first removable portion 140 includes a cutout 158 that partially defines a peripheral edge 160 extending in the longitudinal direction. In this example, the cutout 158 also is substantially semi-circular or arcuate in shape. The cutout 158 may have any suitable shape as needed or desired, and may or may not correspond to the shape or dimensions of tab 148. The first removable portion 140 further includes a gluing area 162 adjacent the cutout 158 and defined by a perimeter 164. In the blank 100 shown in FIG. 1A, the gluing area 162 is shaped somewhat like an arch or bridge. However, it will be understood that the gluing area may have any suitable shape as needed or desired.

Similarly, the second removable portion 142 includes a tab 166 that partially defines peripheral edge 150 and a cutout 168 that partially defines peripheral edge 160. Tear line 170*a* extends from a first end 172*a* of tab 166 in a direction towards, and may abut, transverse tear line 144. Tear line 170*b* extends from a second end 172*b* of tab 166 in a direction towards, and may abut, transverse tear line 146. The second removable portion 140 further includes a gluing area 174 adjacent the cutout 168 and defined by a perimeter 176. As discussed above, the tab 166, cutout 168, tear lines 170*a* and 170*b*, and gluing area 174 may have any shape as needed or desired including, but not limited to, those described above.

Numerous materials may be suitable for use in forming the various blanks and constructs of the invention, provided that the materials are resistant to softening, scorching, combusting, or degrading at typical microwave oven heating temperatures, for example, at from about 250° F. to about 425° F. The particular materials used may include microwave energy interactive materials and microwave energy transparent or inactive materials.

For example, any of the various blanks or constructs of the present invention may include one or more features that alter the effect of microwave energy during the heating or cooking of the food item. For example, the blank or construct may be formed at least partially from one or more microwave energy interactive elements (hereinafter sometimes referred to as "microwave interactive elements") that promote browning and/or crisping of a particular area of the food item, shield a particular area of the food item from microwave energy to prevent overcooking thereof, or transmit microwave energy toward or away from a particular area of the food item. Each microwave interactive element comprises one or more microwave energy interactive materials or segments arranged in a particular configuration to absorb microwave energy, transmit microwave energy, reflect microwave energy, or direct microwave energy, as needed or desired for a particular microwave heating construct and food item.

The microwave interactive element may be supported on a microwave inactive or transparent substrate for ease of handling and/or to prevent contact between the microwave interactive material and the food item. As a matter of convenience and not limitation, and although it is understood that a microwave interactive element supported on a microwave transparent substrate includes both microwave interactive and microwave inactive elements or components, such constructs are referred to herein as "microwave interactive webs".

The microwave energy interactive material may be an electroconductive or semiconductive material, for example, a metal or a metal alloy provided as a metal foil; a vacuum deposited metal or metal alloy; or a metallic ink, an organic ink, an inorganic ink, a metallic paste, an organic paste, an inorganic paste, or any combination thereof. Examples of metals and metal alloys that may be suitable for use with the present invention include, but are not limited to, aluminum, chromium, copper, inconel alloys (nickel-chromium-molybdenum alloy with niobium), iron, magnesium, nickel, stainless steel, tin, titanium, tungsten, and any combination or alloy thereof.

Alternatively, the microwave energy interactive material may comprise a metal oxide. Examples of metal oxides that may be suitable for use with the present invention include, but are not limited to, oxides of aluminum, iron, and tin, used in conjunction with an electrically conductive material where needed. Another example of a metal oxide that may be suitable for use with the present invention is indium tin oxide (ITO). ITO can be used as a microwave energy interactive material to provide a heating effect, a shielding effect, a browning and/or crisping effect, or a combination thereof. For example, to form a susceptor, ITO may be sputtered onto a clear polymer film. The sputtering process typically occurs at a lower temperature than the evaporative deposition process used for metal deposition. ITO has a more uniform crystal structure and, therefore, is clear at most coating thicknesses. Additionally, ITO can be used for either heating or field management effects. ITO also may have fewer defects than metals, thereby making thick coatings of ITO more suitable for field management than thick coatings of metals, such as aluminum.

Alternatively, the microwave energy interactive material may comprise a suitable electroconductive, semiconductive, or non-conductive artificial dielectric or ferroelectric. Artificial dielectrics comprise conductive, subdivided material in a polymeric or other suitable matrix or binder, and may include flakes of an electroconductive metal, for example, aluminum.

Figure 1B:
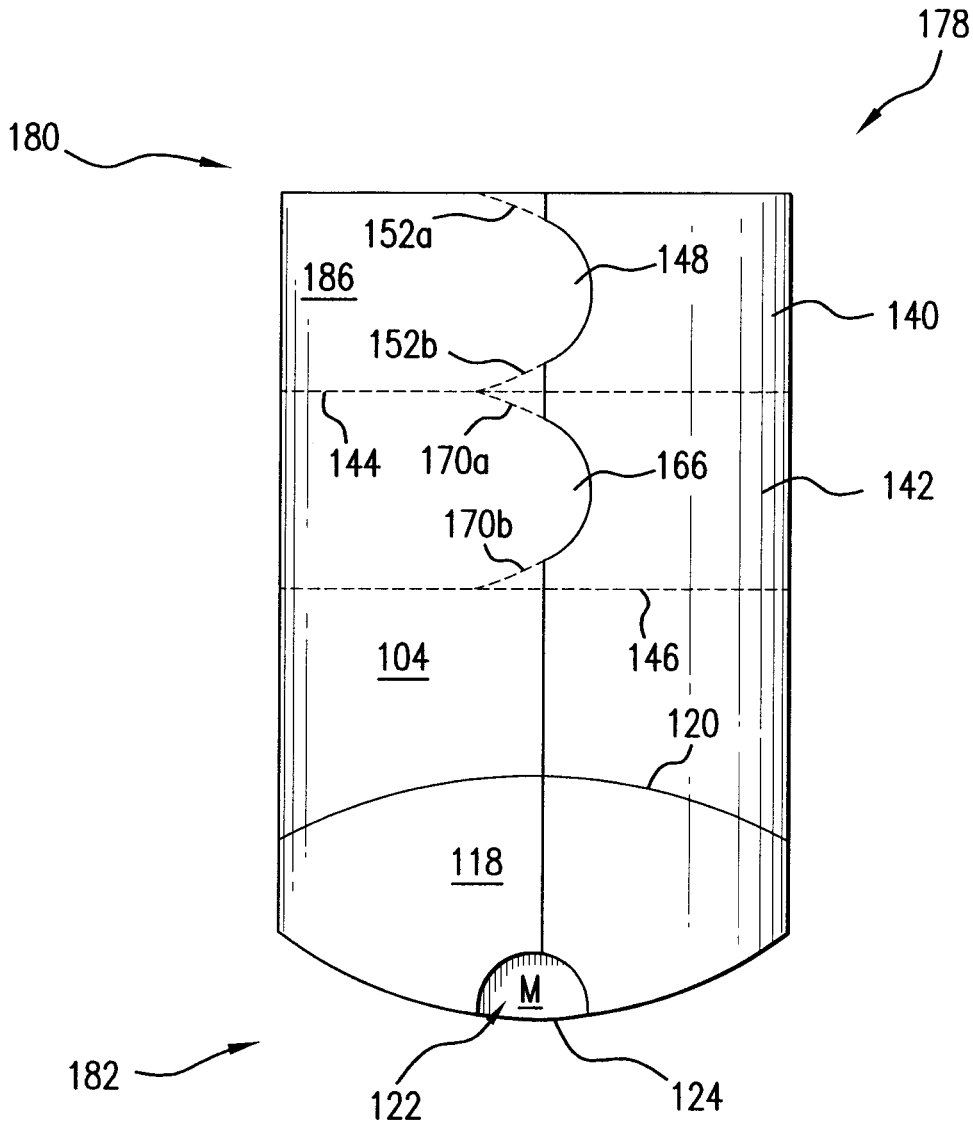
FIGS. 1B and 1C illustrate the blank of FIG. 1A formed into a sleeve with two open ends, according to various aspects of the present invention.
Figure 1C:
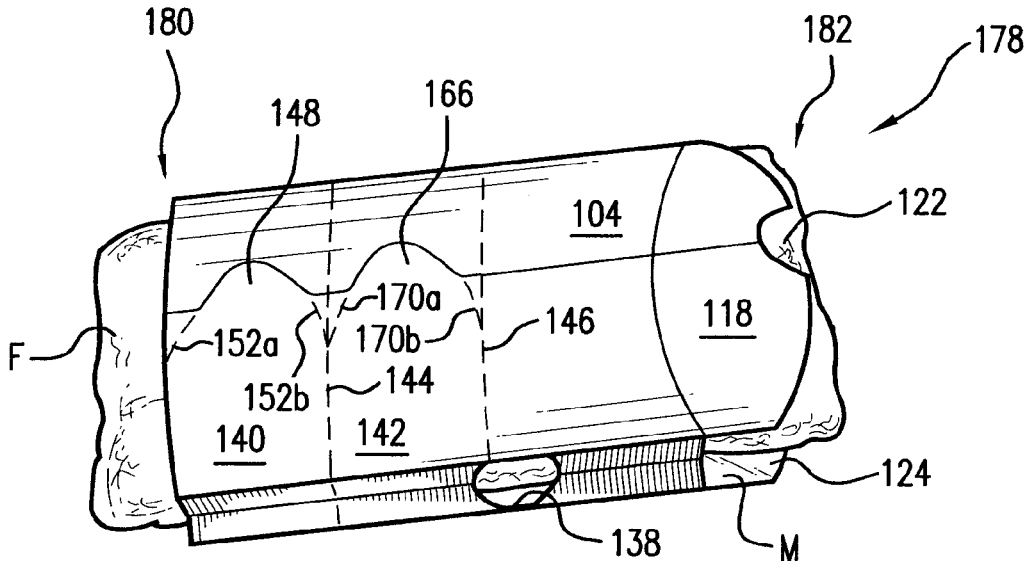
Figure 1D:
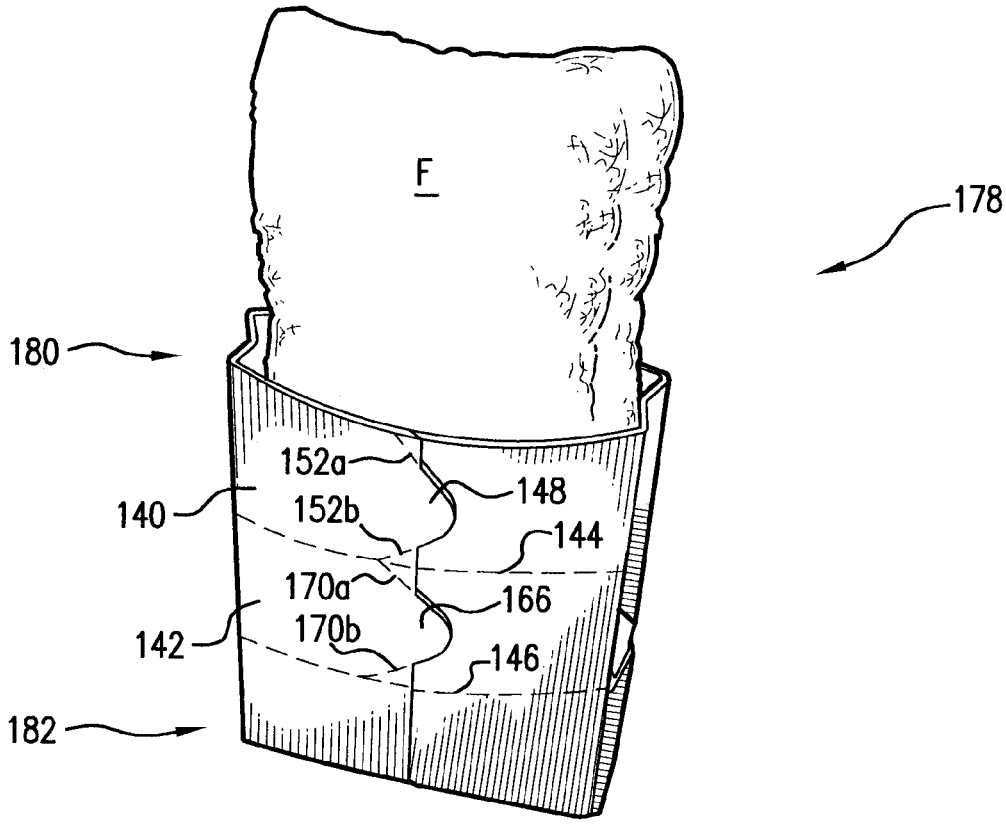
FIGS. 1D-1F illustrate the blank of FIG. 1A formed into a container for carrying a food item therein, according to various aspects of the present invention.
Figure 1E:
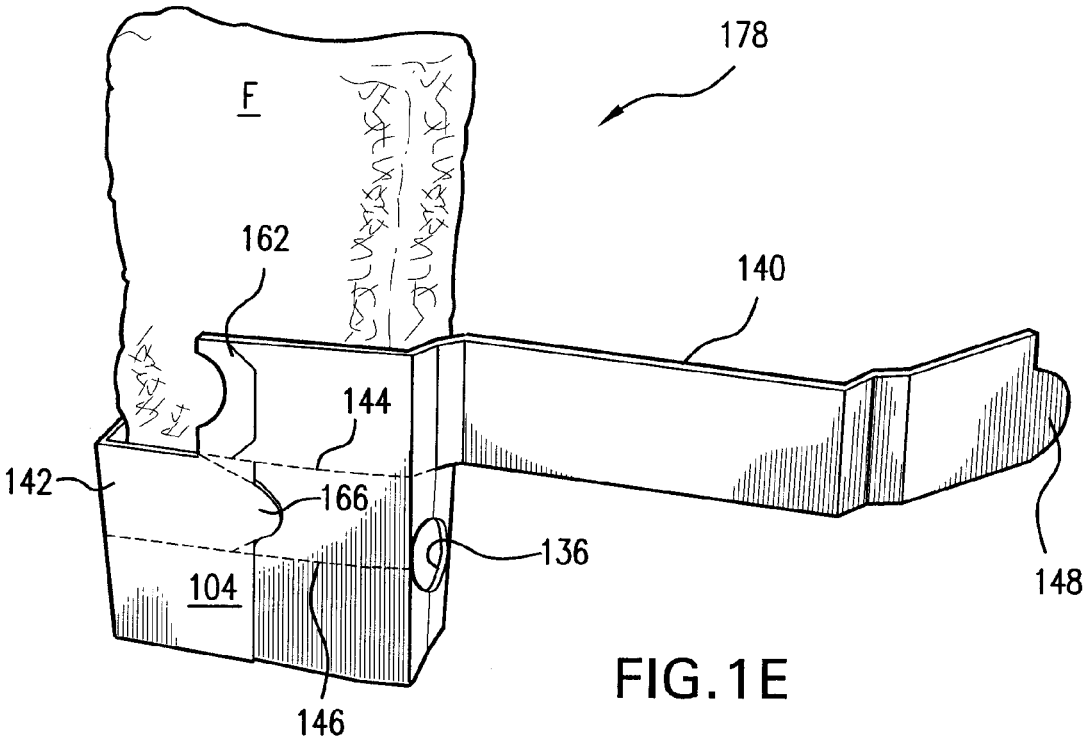
Figure 1F:
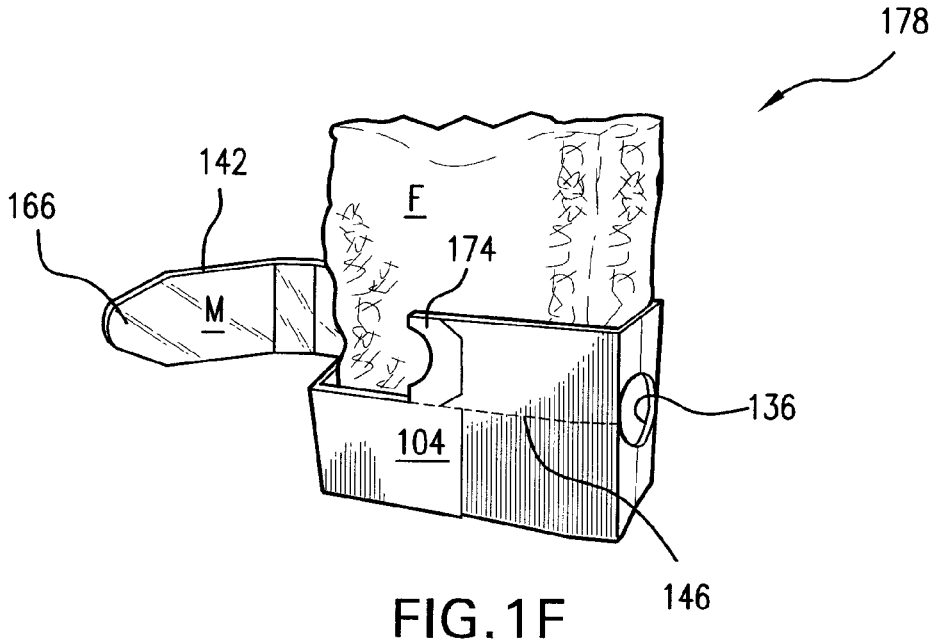

In one example, the microwave interactive element may comprise a thin layer of microwave interactive material, for example, a susceptor, that tends to absorb microwave energy and generate heat at the interface with a food item in intimate or proximate contact therewith. Such elements often are used to promote browning and/or crisping of the surface of a food item (sometimes referred to as a "browning and/or crisping element"). When supported on a film or other substrate, such an element may be referred to as a "susceptor film" or, simply, "susceptor". Where the substrate is a blank, carton, or other construct including a plurality of panels, a susceptor may overlie all or a portion of one or more of the panels, and may form at least a portion of the surface proximate the food item. By way of example, and not limitation, a susceptor M may overlie at least a portion of blank 100 (hidden from view in FIG. 1A, which illustrates the side of the blank that forms the exterior surface of the construct), and may form at least a portion of the interior surface of the construct 178 formed therefrom, as depicted in FIGS. 1B, 1C, and 1F. However, other microwave energy interactive elements, such as those described herein, are contemplated for use with the invention.

For example, the microwave interactive element may comprise a foil having a thickness sufficient to shield one or more selected portions of the food item from microwave energy (sometimes referred to as a "shielding element"). Such shielding elements may be used where the food item is prone to scorching or drying out during heating. The shielding element may be formed from various materials and may have various configurations, depending on the particular application for which the shielding element is used. Typically, the shielding element is formed from a conductive, reflective metal or metal alloy, for example, aluminum, copper, or stainless steel. The shielding element generally may have a thickness of from about 0.000285 inches to about 0.05 inches. In one aspect, the shielding element has a thickness of from about 0.0003 inches to about 0.03 inches. In another aspect, the shielding element has a thickness of from about 0.00035 inches to about 0.020 inches, for example, 0.016 inches.

As still another example, the microwave interactive element may comprise a segmented foil, such as, but not limited to, those described in U.S. Pat. Nos. 6,204,492, 6,433,322, 6,552,315, and 6,677,563, each of which is incorporated by reference in its entirety. Although segmented foils are not continuous, appropriately spaced groupings of such segments often act as a transmitting element to direct microwave energy to specific areas of the food item. Such foils also may be used in combination with browning and/or crisping elements, for example, susceptors.

Any of the numerous microwave interactive elements described herein or contemplated hereby may be substantially continuous, that is, without substantial breaks or interruptions, or may be discontinuous, for example, by including one or more breaks or apertures that transmit microwave energy therethrough. The breaks or apertures may be sized and/or positioned to heat particular areas of the food item selectively. As stated previously, the number, shape, size, and positioning of such breaks or apertures may vary for a particular application depending on type of construct being formed, the food item to be heated therein or thereon, the desired degree of shielding, browning, and/or crisping, whether direct exposure to microwave energy is needed or desired to attain uniform heating of the food item, the need for regulating the change in temperature of the food item through direct heating, whether and to what extent there is a need for venting, and numerous other factors.

It will be understood that the aperture may be a physical aperture or void in the material used to form the construct, or may be a non-physical "aperture". A non-physical aperture may be a portion of the construct that is microwave energy inactive by deactivation or otherwise, or one that is otherwise transparent to microwave energy. Thus, for example, the aperture may be a portion of the construct formed without a microwave energy interactive material or, alternatively, may be a portion of the construct formed with a microwave energy interactive material that has been deactivated. While both physical and non-physical apertures allow the food item to be heated directly by the microwave energy, a physical aperture also provides a venting function to allow steam or other vapors to be released from the food item.

It also may be beneficial to create one or more discontinuities or inactive regions to prevent overheating or charring of the construct. By way of example, and not limitation, in the construct 178 illustrated in FIG. 1C, panels 104*a* and 104*b* are overlapped to form a second main panel 104, as will be discussed below. When exposed to microwave energy, the concentration of heat generated by the overlapped panels may be sufficient to cause the underlying support, in this case, paperboard, to become scorched. As such, the overlapping portions of one or both of panels 104*a* and 104*b* may be designed to be microwave inactive, for example, by forming these areas without a microwave energy interactive material or by deactivating the microwave energy interactive material in these areas.

Further still, one or more panels, portions of panels, or portions of the construct may be designed to be microwave energy inactive to ensure that the microwave energy is focused efficiently on the areas to be browned and/or crisped, rather than being lost to portions of the food item not intended to be browned and/or crisped or to the heating environment.

As stated above, any of the above elements and numerous others contemplated hereby may be supported on a substrate. The substrate typically comprises an electrical insulator, for example, a polymer film or other polymeric material. As used herein the terms "polymer", "polymer film", and "polymeric material" include, but are not limited to, homopolymers, copolymers, such as for example, block, graft, random, and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic, and random symmetries.

The thickness of the film typically may be from about 35 gauge to about 10 mil. In one aspect, the thickness of the film is from about 40 to about 80 gauge. In another aspect, the thickness of the film is from about 45 to about 50 gauge. In still another aspect, the thickness of the film is about 48 gauge. Examples of polymer films that may be suitable include, but are not limited to, polyolefins, polyesters, polyamides, polyimides, polysulfones, polyether ketones, cellophanes, or any combination thereof. Other non-conducting substrate materials such as paper and paper laminates, metal oxides, silicates, cellulosics, or any combination thereof, also may be used.

In one example, the polymer film comprises polyethylene terephthalate (PET). Polyethylene terephthalate films are used in commercially available susceptors, for example, the QWIKWAVE® Focus susceptor and the MICRORITE® susceptor, both available from Graphic Packaging International (Marietta, Ga.). Examples of polyethylene terephthalate films that may be suitable for use as the substrate include, but are not limited to, MELINEX®, commercially available from DuPont Teijan Films (Hopewell, Va.), SKYROL, commercially available from SKC, Inc. (Covington, Ga.), and BARRIALOX PET, available from Toray Films (Front Royal, Va.), and QU50 High Barrier Coated PET, available from Toray Films (Front Royal, Va.).

The polymer film may be selected to impart various properties to the microwave interactive web, for example, printability, heat resistance, or any other property. As one particular example, the polymer film may be selected to provide a water barrier, oxygen barrier, or a combination thereof. Such barrier film layers may be formed from a polymer film having barrier properties or from any other barrier layer or coating as desired. Suitable polymer films may include, but are not limited to, ethylene vinyl alcohol, barrier nylon, polyvinylidene chloride, barrier fluoropolymer, nylon 6, nylon 6,6, coextruded nylon 6/EVOH/nylon 6, silicon oxide coated film, barrier polyethylene terephthalate, or any combination thereof.

One example of a barrier film that may be suitable for use with the present invention is CAPRAN® EMBLEM 1200M nylon 6, commercially available from Honeywell International (Pottsville, Pa.). Another example of a barrier film that may be suitable is CAPRAN® OXYSHIELD OBS monoaxially oriented coextruded nylon 6/ethylene vinyl alcohol (EVOH)/nylon 6, also commercially available from Honeywell International. Yet another example of a barrier film that may be suitable for use with the present invention is DARTEK® N-201 nylon 6,6, commercially available from Enhance Packaging Technologies (Webster, N.Y.). Additional examples include BARRIALOX PET, available from Toray Films (Front Royal, Va.) and QU50 High Barrier Coated PET, available from Toray Films (Front Royal, Va.), referred to above.

Still other barrier films include silicon oxide coated films, such as those available from Sheldahl Films (Northfield, Minn.). Thus, in one example, a susceptor may have a structure including a film, for example, polyethylene terephthalate, with a layer of silicon oxide coated onto the film, and ITO or other material deposited over the silicon oxide. If needed or desired, additional layers or coatings may be provided to shield the individual layers from damage during processing.

The barrier film may have an oxygen transmission rate (OTR) as measured using ASTM D3985 of less than about 20 $cc/m^2/day$. In one aspect, the barrier film has an OTR of less than about 10 $cc/m^2/day$. In another aspect, the barrier film has an OTR of less than about 1 $cc/m^2/day$. In still another aspect, the barrier film has an OTR of less than about 0.5 $cc/m^2/day$. In yet another aspect, the barrier film has an OTR of less than about 0.1 $cc/m^2/day$.

The barrier film may have a water vapor transmission rate (WVTR) of less than about 100 $g/m^2/day$ as measured using ASTM F1249. In one aspect, the barrier film has a WVTR of less than about 50 $g/m^2/day$. In another aspect, the barrier film has a WVTR of less than about 15 $g/m^2/day$. In yet another aspect, the barrier film has a WVTR of less than about 1 $g/m^2/day$. In still another aspect, the barrier film has a WVTR of less than about 0.1 $g/m^2/day$. In a still further aspect, the barrier film has a WVTR of less than about 0.05 $g/m^2/day$.

Other non-conducting substrate materials such as metal oxides, silicates, cellulosics, or any combination thereof, also may be used in accordance with the present invention.

The microwave energy interactive material may be applied to the substrate in any suitable manner, and in some instances, the microwave energy interactive material is printed on, extruded onto, sputtered onto, evaporated on, or laminated to the substrate. The microwave energy interactive material may be applied to the substrate in any pattern, and using any technique, to achieve the desired heating effect of the food item. For example, the microwave energy interactive material may be provided as a continuous or discontinuous layer or coating including circles, loops, hexagons, islands, squares, rectangles, octagons, and so forth. Examples of various patterns and methods that may be suitable for use with the present invention are provided in U.S. Pat. Nos. 6,765,182; 6,717,121; 6,677,563; 6,552,315; 6,455,827; 6,433,322; 6,410,290; 6,251,451; 6,204,492; 6,150,646; 6,114,679; 5,800,724; 5,759,418; 5,672,407; 5,628,921; 5,519,195; 5,420,517; 5,410,135; 5,354,973; 5,340,436; 5,266,386; 5,260,537; 5,221,419; 5,213,902; 5,117,078; 5,039,364; 4,963,420; 4,936,935; 4,890,439; 4,775,771; 4,865,921; and Re. 34,683, each of which is incorporated by reference herein in its entirety. Although particular examples of patterns of microwave energy interactive material are shown and described herein, it should be understood that other patterns of microwave energy interactive material are contemplated by the present invention.

The microwave interactive element or microwave interactive web may be joined to or overlie a dimensionally stable, microwave energy transparent support (hereinafter referred to as "microwave transparent support", "microwave inactive support" or "support") to form at least a portion of the construct.

In one aspect, for example, where a rigid or semi-rigid construct is to be formed, all or a portion of the support may be formed at least partially from a paperboard material, which may be cut into a blank prior to use in the construct. For example, the support may be formed from paperboard having a basis weight of from about 60 to about 330 lbs/ream, for example, from about 80 to about 140 lbs/ream. The paperboard generally may have a thickness of from about 6 to about 30 mils, for example, from about 12 to about 28 mils. In one particular example, the paperboard has a thickness of about 12 mils. Any suitable paperboard may be used, for example, a solid bleached or solid unbleached sulfate board, such as SUS® board, commercially available from Graphic Packaging International.

In another aspect, where a more flexible construct is to be formed, the support may comprise a paper or paper-based material generally having a basis weight of from about 15 to about 60 lbs/ream, for example, from about 20 to about 40 lbs/ream. In one particular example, the paper has a basis weight of about 25 lbs/ream.

Optionally, one or more portions or sides of the various blanks or other constructs described herein or contemplated hereby may be coated with varnish, clay, or other materials, either alone or in combination. For example, at least the side of the support that will form an exterior surface of a construct erected therefrom may be coated with a clay coating or other base coating. The coating may then be printed over with product advertising, images, price coding, any other information or indicia, or any combination thereof. The blank or construct then may be overcoated with a varnish to protect any information printed thereon.

Furthermore, the blanks or other constructs may be coated with, for example, a moisture and/or oxygen barrier layer, on either or both sides, such as those described above. Any suitable moisture and/or oxygen barrier material may be used in accordance with the present invention. Examples of materials that may be suitable include, but are not limited to, polyvinylidene chloride, ethylene vinyl alcohol, DuPont DARTEK™ nylon 6,6, and others referred to above.

Alternatively or additionally, any of the blanks or other constructs of the present invention may be coated or laminated with other materials to impart other properties, such as absorbency, repellency, opacity, color, printability, stiffness, or cushioning. For example, absorbent susceptors are described in U.S. Provisional Application No. 60/604,637, filed Aug. 25, 2004, and U.S. Patent Application Publication No. US 2006/0049190 A1, published Mar. 9, 2006, both of which are incorporated herein by reference in their entirety.

It will be understood that with some combinations of elements and materials, the microwave interactive element may have a grey or silver color that is visually distinguishable from the substrate or the support. However, in some instances, it may be desirable to provide a web or construct having a uniform color and/or appearance. Such a web or construct may be more aesthetically pleasing to a consumer, particularly when the consumer is accustomed to packages or containers having certain visual attributes, for example, a solid color, a particular pattern, and so on. Thus, for example, the present invention contemplates using a silver or grey toned adhesive to join the microwave interactive elements to the substrate, using a silver or grey toned substrate to mask the presence of the silver or grey toned microwave interactive element, using a dark toned substrate, for example, a black toned substrate, to conceal the presence of the silver or grey toned microwave interactive element, overprinting the metallized side of the web with a silver or grey toned ink to obscure the color variation, printing the non-metallized side of the web with a silver or grey ink or other concealing color in a suitable pattern or as a solid color layer to mask or conceal the presence of the microwave interactive element, or any other suitable technique or combination thereof.

Returning to the figures, numerous sequences and steps may be used to form a construct 178 according to the invention. In one example, the blank 100 is folded along fold lines 110, 112, 114, and 116, and edges 150 and 160 are brought towards each other to form a sleeve 178 having ends 180 and 182 (FIG. 1B) and a cavity or interior space 184 therebetween (FIGS. 1C and 1D).

The first major panel 104*a* and the second major panel 104*b* are overlapped to the extent needed to form a second main panel 104 with the gluing areas 162 and 174 at least partially concealed by the corresponding portions of major panel 104*b*. Thus, except for the overlapped portion of panel 104*a*, FIG. 1A depicts the exterior surface 186 of the construct 178 to be formed. Similarly, partial end panels 118*a* and 118*b* are overlapped to the extent needed to form end panel 118, which is substantially lentiform in shape with a somewhat semi-circular cutout 122 formed by overlapping partial cutouts 122*a* and 122*b*. Further, fold line segments 120*a* and 120*b* are overlapped as needed to form arcuate fold line 120. In this and other aspects of the invention, it will be understood that other shapes for the end panel and cutout are contemplated hereby. For example, the end panel may be oval, rectangular, square, diamond-shaped, trapezoidal, polygonal, or may be any other regular or irregular shape. The cutout may be circular, square, or any other regular or irregular shape.

The overlapped portions may be glued or otherwise joined to form the sleeve 178 with a first removable portion 140 and a second removable portion 142. The first minor panel 106 and second minor panel 108 form opposed side walls of the construct, which may be gusseted by folding inwardly along fold lines 132 and 134 (FIGS. 1C and 1D). In this example, tabs 148 and 166 are not glued or otherwise affixed to the first major panel 104*a*. However, it is understood that the tabs 148 and 166 may be affixed removably to the first major panel 104*a* if desired.

To use the construct, for example, a food item F is inserted through an end 180 or 182, and the construct 178 with the food item F inside is placed into a microwave oven (not shown) to be heated. It is contemplated that in this and other aspects of the invention, any of the panels, for example, the first main panel 102, the first major panel 104*a*, or the second major panel 104*b*, may include one or more fold lines, score lines, cut lines, cut crease lines, or other lines of disruption along all or a portion of the length or width thereof to accommodate the contours of the particular food item heated therein and to bring the susceptor M into closer proximity with the surface of the food item. As the food item is heated, the susceptor M enhances browning and/or crisping of the surface of the food item. Any steam generated during heating may be released through the open ends 180 and 182 of the sleeve, or through apertures 136 and 138.

After the item is heated sufficiently, the user may remove the food item F from the construct or may fold end panels 118 and 124 towards the interior 184 of the sleeve 178 to form a construct having an open end 180 and a closed end 182, as shown in FIG. 1D. In this and other aspects of the invention, the end panels may be folded inwardly in any order. Thus, for example, end panel 118 may be folded inwardly before folding end panel 124 inwardly, or end panel 124 may be folded inwardly before folding end panel 118 inwardly. In either configuration, the construct 178 may be positioned in an upright position such that the food item F is supported by the end panels 118 and 124, which serve as a base for the container. This provides a convenient means for comfortably handling the heated food item F.

As the food item F is consumed, the construct 178 may begin to interfere with accessing the food item F. If desired, the user may grasp and pull tab 148 in a direction away from the construct 178. By doing so, the removable portion 140 will begin to separate from the remaining portions of the construct 178 along tear lines 152*a*, 152*b*, and 144, as shown in FIG. 1E. Further pulling results in complete separation of the first removable portion 140 from the construct 178, as shown in FIG. 1F.

As the food item is consumed further, the construct 178 again may begin to interfere with accessing the food item F. If desired, the user may grasp and pull tab 166 in a direction away from the construct 178. By doing so, the removable portion 142 will begin to separate from the remaining portions of the construct 178 along tear lines 170*a*, 170*b*, and 146, as shown in FIG. 1F. Further pulling results in complete separation (not shown) of the second removable portion 142 from the construct 178, thereby providing greater access to the food item F therein.

Although the removable portions 140 and 142 are described herein as being removed sequentially herein, it will be understood that both panels 140 and 142 may be removed simultaneously simply by grasping both tabs 148 and 166 and tearing the panels along tear line 146. This may be useful when, for example, the user has consumed a significant portion of the food item without having removed the first removable portion 140 and greater access is needed.

Figure 2A:
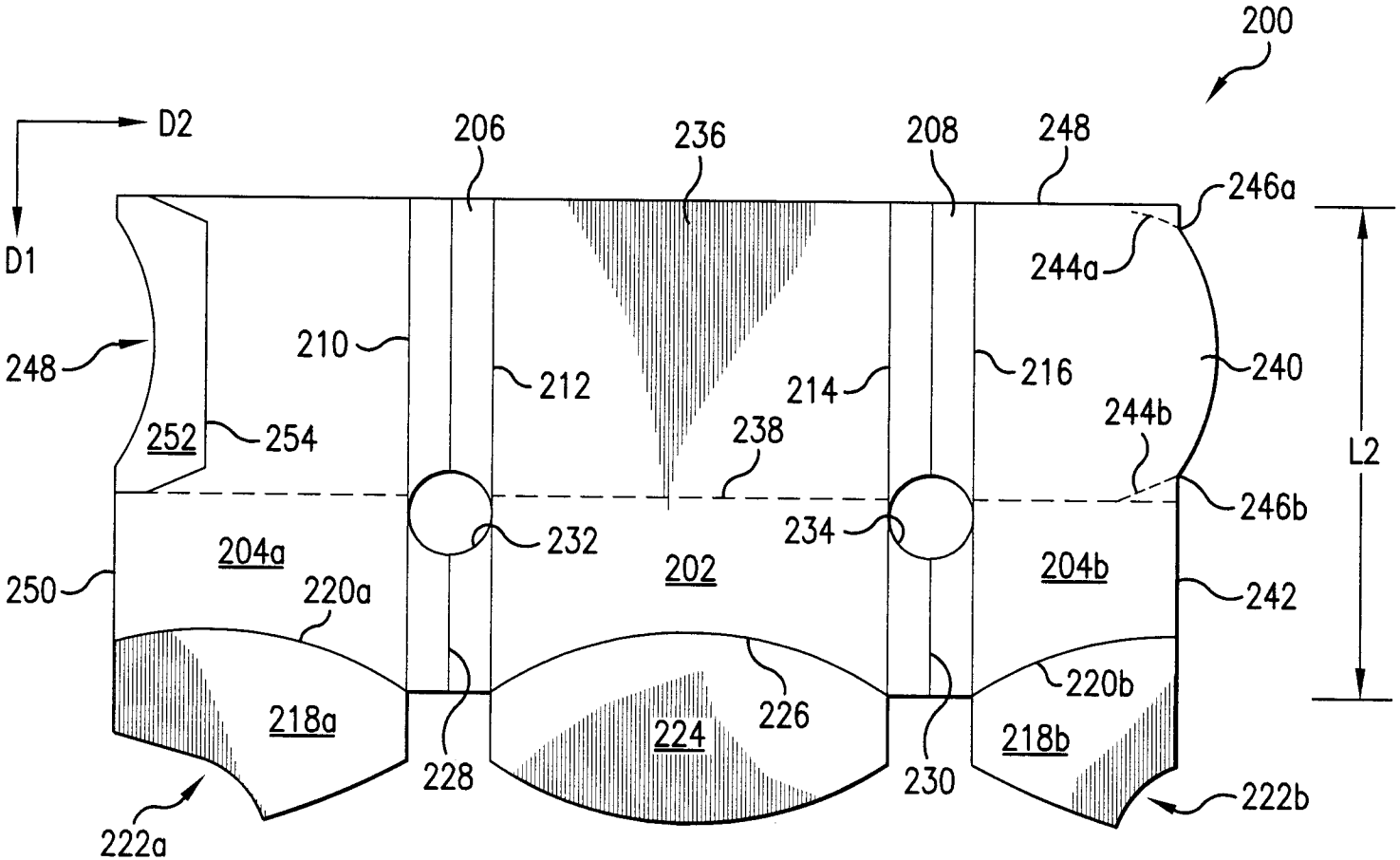
FIG. 2A depicts another exemplary blank according to various aspects of the present invention.

FIG. 2A depicts another exemplary blank 200 according to various aspects of the invention. In this example, the blank 200 includes a plurality of adjoined panels including a main panel 202, a first major panel 204*a*, a second major panel 204*b*, a first minor panel 206, and a second minor panel 208. The first minor panel 206 is joined to the first major panel 204*a* along a longitudinal fold line 210. The main panel 202 is joined to the first minor panel 206 along a longitudinal fold line 212. The second minor panel 208 is joined to the main panel 202 along a longitudinal fold line 214. The second major panel 204*b* is joined to the second minor panel 208 along a longitudinal fold line 216. In this example, minor panels 206 and 208 are substantially equal in length, as indicated by L2. Additionally, fold lines 210, 212, 214, and 216 are substantially parallel and substantially equal in length, L2. However, other lengths and configurations are contemplated hereby.

The blank 200 includes partial end panels 218*a* and 218*b* respectively joined to panels 204*a* and 204*b* along respective fold line segments 220*a* and 220*b*. Each of the partial end panels 218*a* and 218*b* respectively include a partial cutout 222*a* and 222*b*. The blank 200 further includes an end panel 224 joined to the main panel 202 along fold line 226. In this example, the end panel 224 is substantially lentiform in shape. However, the end panel 224 may have any suitable shape.

The first minor panel 206 and the second minor panel 208 each include respective longitudinal fold lines 228 and 230 substantially centrally disposed and extending along the length L2 thereof. Optionally, one or both of the first minor panel 206 and the second minor panel 208 include respective apertures 232 and 234. In the example shown in FIG. 2A, aperture 232 is substantially circular in shape and extends substantially between fold lines 210 and 212. Likewise, aperture 234 is substantially circular in shape and extends substantially between fold lines 214 and 216. However, as stated above, the number, shape, and positioning of such apertures may vary for a particular application.

Still viewing FIG. 2A, the blank 200 includes a removable portion 236 extending across and formed from least a portion of each of panels 202, 204*a*, 204*b*, 206, and 208. The removable portion 236 is joined to the remainder of panels 202, 204*a*, and 204*b* along a transverse line of disruption or tear line 238 that, in this example, is interrupted by apertures 232 and 234. It will be understood that while the exemplary blank 200 of FIG. 2B includes only one removable portion 236, any number of such panels and any configuration of such panels may be used as desired.

The removable portion 236 includes an extension or tab 240 that partially defines edge 242. In this example, the tab 240 is somewhat arcuate in shape. However, it will be understood that the extension may have any shape as needed or desired. Tear line 244*a* extends from a first end 246*a* of extension 240 towards, and may abut, edge 248. Tear line 244*b* extends from a second end 246*b* of tab 240 in a direction towards, and may abut, transverse tear line 238. In this example, tear lines 244*a* and 244*b* are positioned relative to extension 240 such that the combination of tear line 244*a*, tab 240, and tear line 244*b* is somewhat arcuate in shape. However, it will be understood that such tear lines may have any suitable shape and may or may not correspond to or extend the shape of the tab. Thus, for example, although the tab 240 is somewhat arcuate in shape, the tear line segments 244*a* and 244*b* may be parallel lines, zigzags, or any other configuration. Tear lines 244*a* and 244*b* cooperate with tab 240 to facilitate removal of the first removable portion 236, as will be discussed below.

The removable portion 236 also includes a cutout 248 that partially defines edge 250. In this example, the cutout 248 also is somewhat arcuate in shape. As with the tab, the cutout may have any suitable shape as needed or desired including, but not limited to, those described above, and may or may not correspond to the shape or dimensions of the tab. The removable portion 236 also includes a gluing area 252 adjacent the cutout 248 and defined by a perimeter 254. In the blank 200 shown in FIG. 2A, the gluing area 252 is shaped somewhat like an arch or bridge. However, it will be understood that the gluing area may have any suitable shape as needed or desired.

Figure 2B:
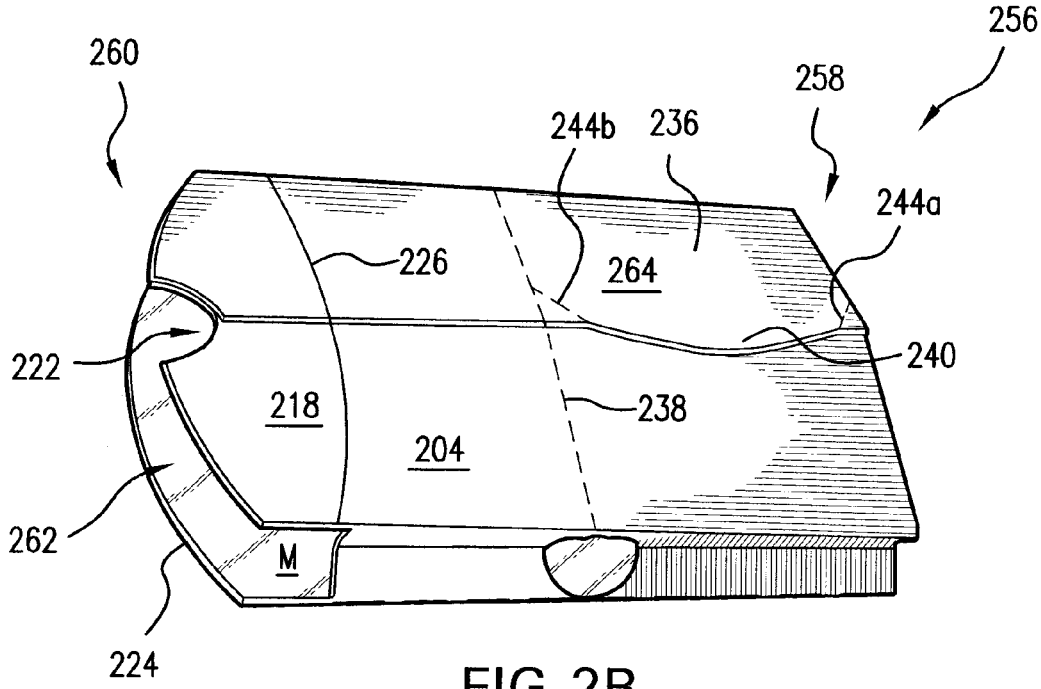
FIG. 2B illustrates the blank of FIG. 2A formed into a sleeve with two open ends, according to various aspects of the present invention.
Figure 2C:
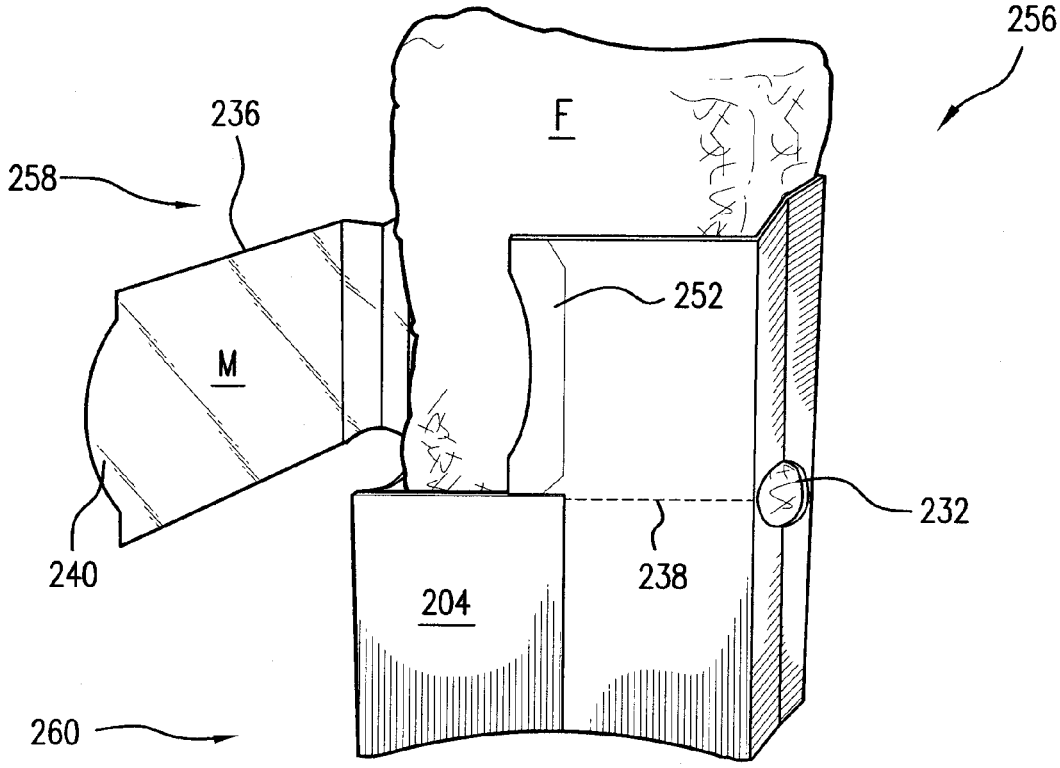
FIG. 2C illustrates the blank of FIG. 2A formed into a container for supporting a food item therein, according to various aspects of the present invention.

If desired, a susceptor M may overlie at least a portion of blank 200 (hidden from view in FIG. 2A, which illustrates the side of the blank that forms the exterior surface of the construct), and may form at least a portion of the interior surface of the construct 256 formed therefrom, as can be seen in FIGS. 2B and 2C. However, other microwave energy interactive elements, such as those described herein, are contemplated for use with the invention.

Numerous steps and sequences thereof may be used to form a sleeve or other construct 256 according to the invention. In one example, the blank 200 is folded along fold lines 210, 212, 214, and 216, and edges 242 and 250 are brought towards each other to form a sleeve 256 with ends 258 and 260 and a cavity or interior space 262 therebetween (FIG. 2B).

The first and second major panels 204*a* and 204*b* are overlapped to the extent needed to form a second main panel 204 with gluing area 252 at least partially concealed by second major panel 204*b*. Thus, except for the overlapped portion of major panel 204*a*, FIG. 2A depicts the exterior surface 264 of the construct 256 to be formed. Similarly, partial end panels 218*a* and 218*b* are overlapped to the extent needed to form end panel 218, which is substantially lentiform in shape with a somewhat semi-circular cutout 222 formed by overlapping partial cutouts 222*a* and 222*b*. Further, fold line segments 220*a* and 220*b* are overlapped as needed to form arcuate fold line 220. As discussed above, other shapes for the end panel and cutout are contemplated hereby.

The overlapped portions then may be glued or otherwise joined to form a sleeve 256 having a removable portion 236 comprising the removable portion 236 of the blank 200. In this configuration, the first minor panel 206 and second minor panel 208 form opposed side walls for the construct 256, which may be gusseted by folding inwardly along fold lines 228 and 230, as shown in FIG. 2B. In this example, extension or tab 240 is not glued or otherwise affixed to panel 204*a*. However, it is understood that the tab 240 may be affixed removably to panel 204*a* if desired.

To use the construct, for example, a food item F is inserted through an open end 258 or 260, and the construct 256 with the food item inside is placed into a microwave oven (not shown) to be heated. As the food item is heated, the susceptor M enhances browning and/or crisping of the surface of the food item. Any steam generated during heating may be released through the open ends 258 and 260 of the sleeve, or through apertures 232 and 234.

After the item is heated sufficiently, the user may remove the food item from the construct or may fold the end panels 218 and 224 towards the interior 262 of the sleeve 256 to form a construct or container having one open end 258 and one closed end 260 (FIG. 2C). By doing so, the construct 256 may be positioned such that the food item is supported by the end panels 218 and 224, which serve as a base for the container.

As the food item (not shown) is consumed, the construct 256 may begin to interfere with accessing the food item. If desired, the user may grasp and pull tab or extension 240 in a direction away from the construct 256, as shown in FIG. 2C. By doing so, the removable portion 236 will begin to separate from the remaining portions of the construct 256 along tear lines 244*a*, 244*b*, and 238. Further pulling results in complete separation of the removable portion 236 from the construct 256. As a result, the food item can be accessed readily.

Figure 3A:
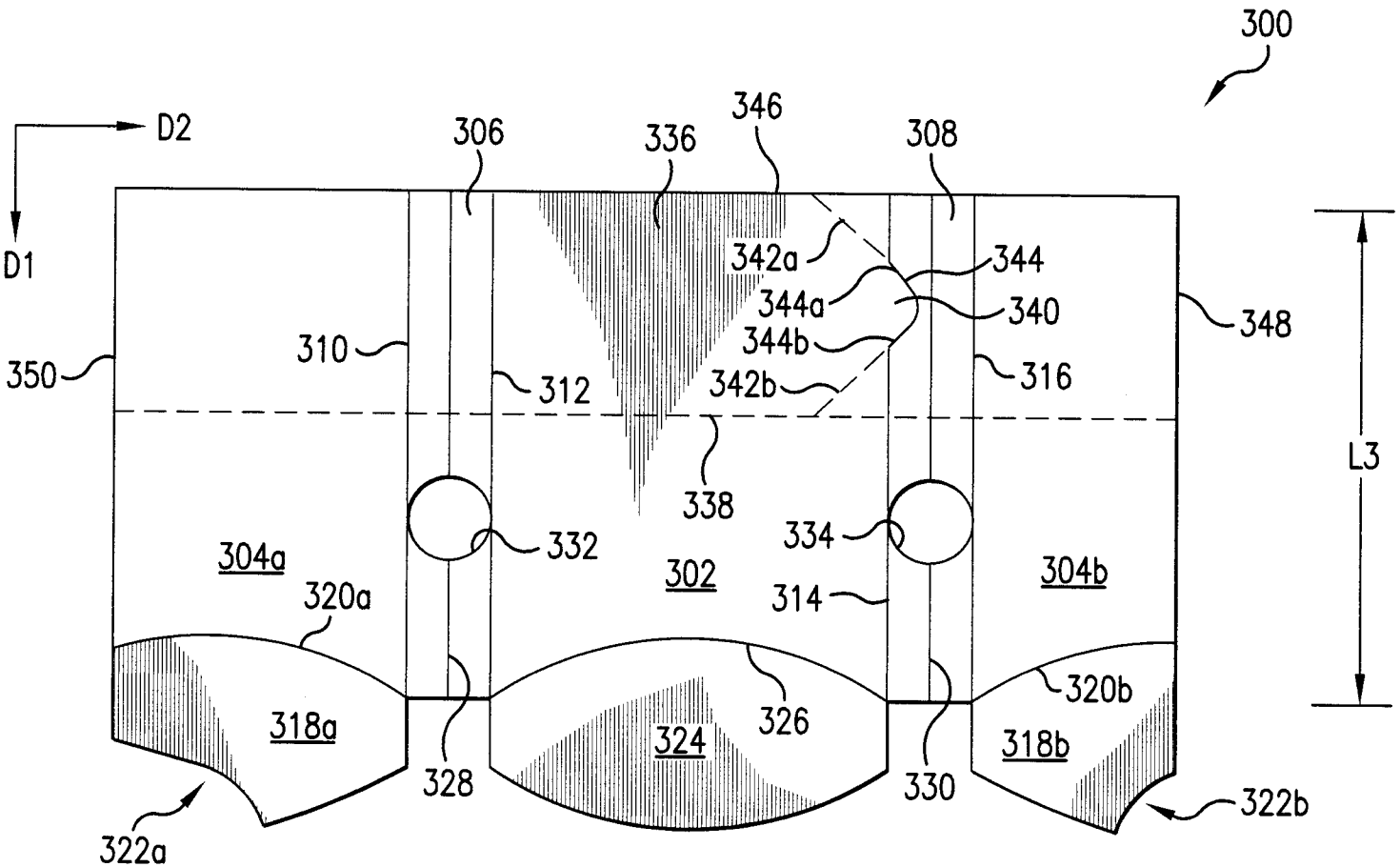
FIG. 3A depicts yet another exemplary blank according to various aspects of the present invention.

Another exemplary blank 300 is illustrated in FIG. 3A. The blank 300 includes a plurality of adjoined panels including a main panel 302, a first major panel 304*a*, a second major panel 304*b*, a first minor panel 306, and a second minor panel 308. The first minor panel 306 is joined to first major panel 304*a* along a longitudinal fold line 310. The main panel 302 is joined to the first minor panel 306 along a longitudinal fold line 312. The second minor panel 308 is joined to the main panel 302 along a longitudinal fold line 314. The second major panel 304*b* is joined to the second minor panel 308 along a longitudinal fold line 316. In this example, minor panels 306 and 308 are substantially equal in length, L3. Additionally, fold lines 310, 312, 314, and 316 are substantially parallel and substantially equal in length, L3. However, other lengths and configurations are contemplated hereby.

The blank 300 includes partial end panels 318*a* and 318*b* respectively joined to panels 304*a* and 304*b* along respective curved fold line segments 320*a* and 320*b*. Optionally, the partial end panels 318*a* and 318*b* each include a partial cutout 322*a* and 322*b*. The blank 300 includes an end panel 324 joined to the main panel 302 along a somewhat arcuate fold line 326. In this example, the end panel 324 is substantially lentiform in shape. However, it is contemplated that the end panels may have any suitable shape.

The first minor panel 306 and the second minor panel 308 each include respective longitudinal fold lines 328 and 330 substantially centrally disposed and extending along the length L3 thereof. Optionally, one or both of the first minor panel 306 and the second minor panel 308 include respective apertures 332 and 334. In the example shown in FIG. 3A, aperture 332 is substantially circular in shape and extends between fold lines 310 and 312. Aperture 334 is substantially circular in shape and extends between longitudinal fold lines 314 and 316. However, as stated above, any number and configuration of apertures may be used.

Still viewing FIG. 3A, the blank 300 includes a removable portion 336 extending across and formed from least a portion of each of panels 302, 304*a*, 304*b*, 306, and 308. The removable portion 336 is joined to the remainder of panels 302, 304*a*, and 304*b* along a transverse tear line 338. It will be understood that while the exemplary blank 300 of FIG. 3A includes only one removable portion 336, any number of such portions or panels and any configuration of such panels may be used as desired.

The removable portion 336 includes a somewhat triangular tab 340 extending from the main panel 302. In this example, the tab 340 comprises at least a portion of minor panel 308 and is defined by a somewhat arcuate or V-shaped cut line 344. However, it will be understood that the location and shape of the tab 340 may vary for a particular application. Tear line 342*a* extends from a first end 344*a* of cut line 344 towards, and may abut, edge 346. Tear line 342*b* extends from a second end 344*b* of cut line 344 in a direction towards, and may abut substantially, transverse tear line 338. In this example, tear lines 342*a* and 342*b* are positioned relative to tab 340 such that the combination of tear lines 342*a*, 344, and 342*b* is somewhat V-shaped. However, it will be understood that such tear lines may have any suitable shape and may or may not correspond to or extend the shape of the tab. Thus, for example, although the tab 340 is somewhat triangular, the tear line segments 342*a* and 342*b* may be parallel lines, zigzags, or any other configuration. Tear line segments 342*a* and 342*b* cooperate with tab 340 to facilitate removal of the removable portion 336, as will be discussed below.

If desired, a susceptor M may overlie at least a portion of blank 300 (hidden from view in FIG. 3A, which illustrates the side of the blank that forms the exterior surface of the construct), and may form at least a portion of the interior surface of the construct 352 formed therefrom, as can be seen in FIGS. 3B-3F. However, other microwave energy interactive elements, such as those described herein, are contemplated for use with the invention.

Figure 3B:
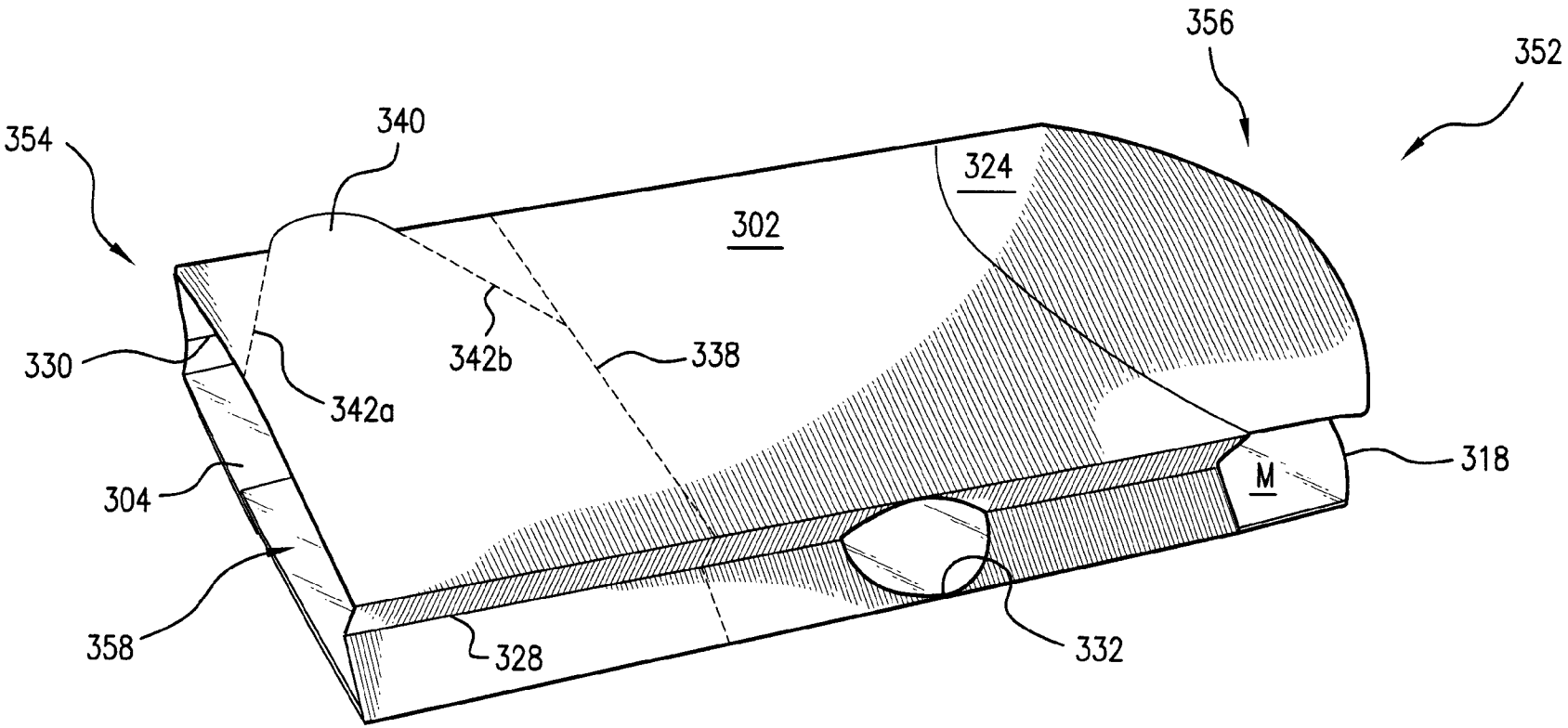
FIG. 3B illustrates the blank of FIG. 3A formed into a sleeve with two open ends, according to various aspects of the present invention.

Numerous sequences of steps may be used to form a sleeve or other construct 352 according to the invention. In one example, the blank 300 is folded along longitudinal fold lines 310, 312, 314, and 316, and edges 348 and 350 are brought towards each other to form a sleeve 352 having two open ends 354 and 356 with a cavity or interior space 358 therebetween, as shown in FIG. 3B. The first and second major panels 304*a* and 304*b* are overlapped as needed to form a second main panel 304, partial end panels 318*a* and 318*b* are overlapped as needed to form end panel 318, fold line segments 320*a* and 320*b* are overlapped as needed to form fold line 320, and partial cutouts 322*a* and 322*b* are overlapped as needed to form cutout 322. In this example, the cutout 322 is somewhat semi-circular in shape. However, it will be understood that numerous other shapes are contemplated hereby.

The overlapped portions may be glued or otherwise joined to form a sleeve 352 including a removable portion 336 comprising the removable portion 336 of the blank 300. The first minor panel 306 and second minor panel 308 form opposed side walls for the construct, which may be gusseted by folding inwardly along fold lines 328 and 330 (FIG. 3D).

To use the construct, a food item (not shown) is inserted through an open end 354 or 356, and the construct 352 with the food item inside is placed into a microwave oven (not shown) to be heated. As the food item is heated, the susceptor M enhances browning and/or crisping of the surface of the food item. Any steam generated during heating may be released through open ends 354 and 356 of the sleeve or through apertures 332 and 334.

Figure 3D:
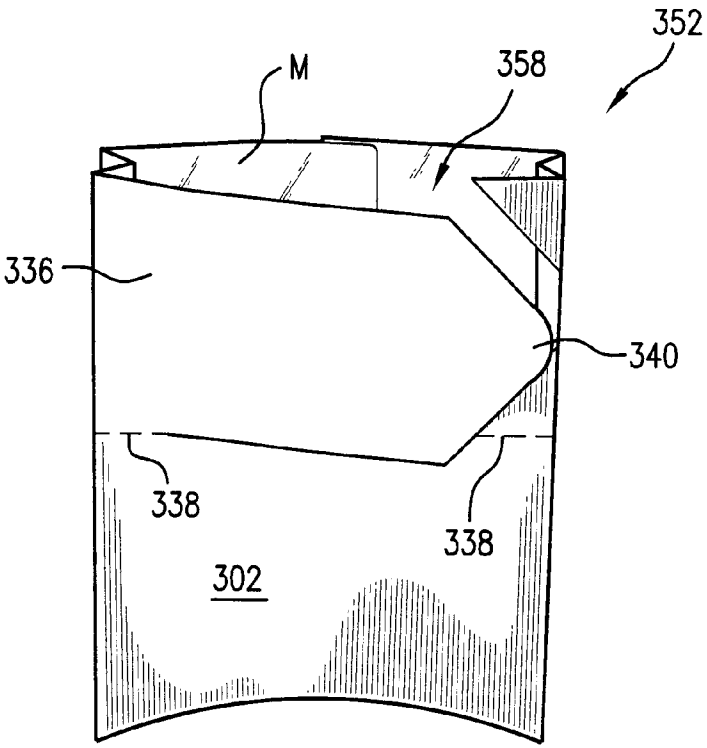
FIGS. 3C-3F illustrate the blank of FIG. 3A formed into a container for carrying a food item therein, according to various aspects of the present invention.
Figure 3C:
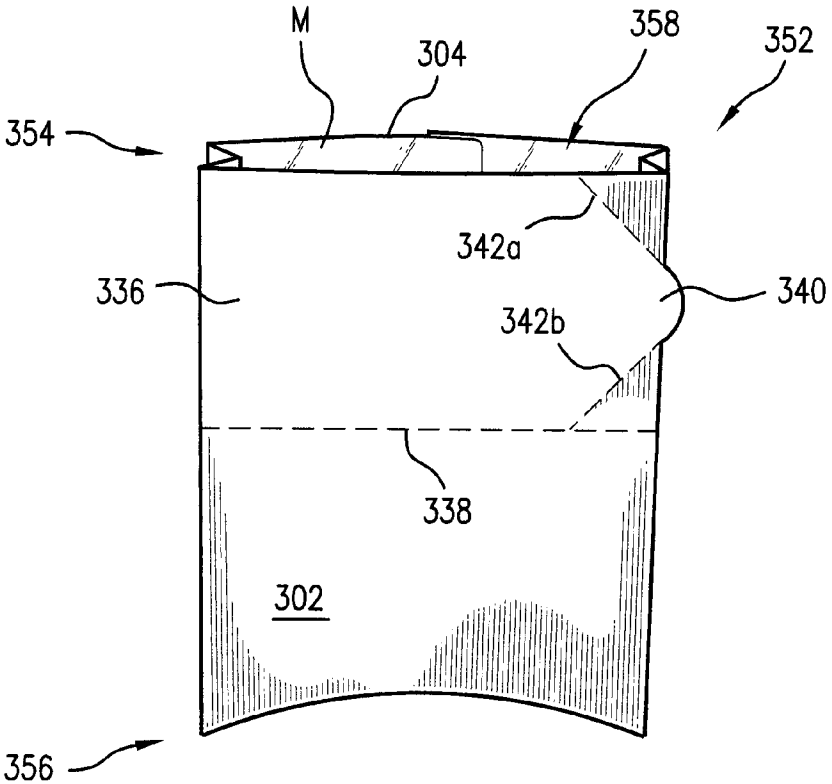

After the item is heated sufficiently, the user may remove the food item from the construct or may fold the end panels 318 and 324 towards the interior 358 of the sleeve to form a container 352 having an open end 354 and a closed end 356, as shown in FIG. 3C. The construct 352 then may be positioned in an upright configuration with the food item supported by the inwardly folded, superposed end panels 318 and 324, which serve as a base for the container. This provides a convenient means for gripping the food item without the discomfort of contacting the surface of the heated food item.

Figure 3E:
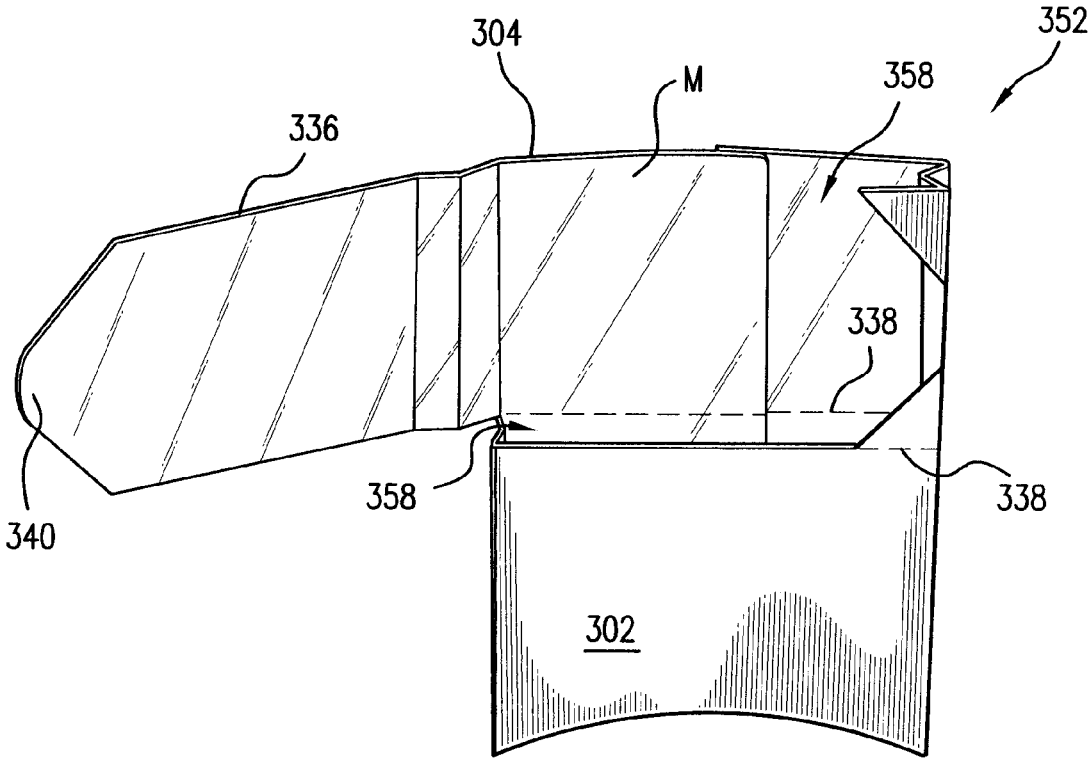
Figure 3F:
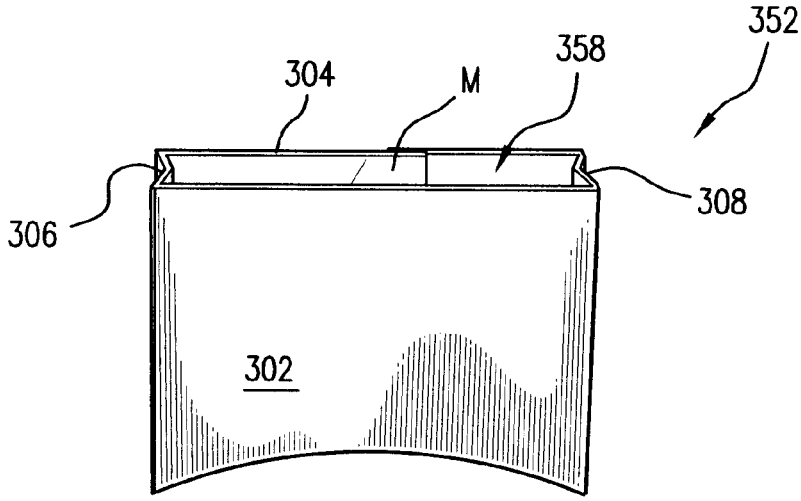

Turning to FIGS. 3D-3F, as the food item is consumed, the construct may begin to interfere with accessing the food item. If desired, the user may grasp and pull tab 340 in a direction away from the construct. By doing so, the removable portion 336 will begin to separate from the remaining portions of the construct along tear lines 342*a*, 342*b*, and 338. Further pulling results in complete separation of the removable portion 336 from the construct, thereby allowing greater access to the food item therein.

Figure 4A:
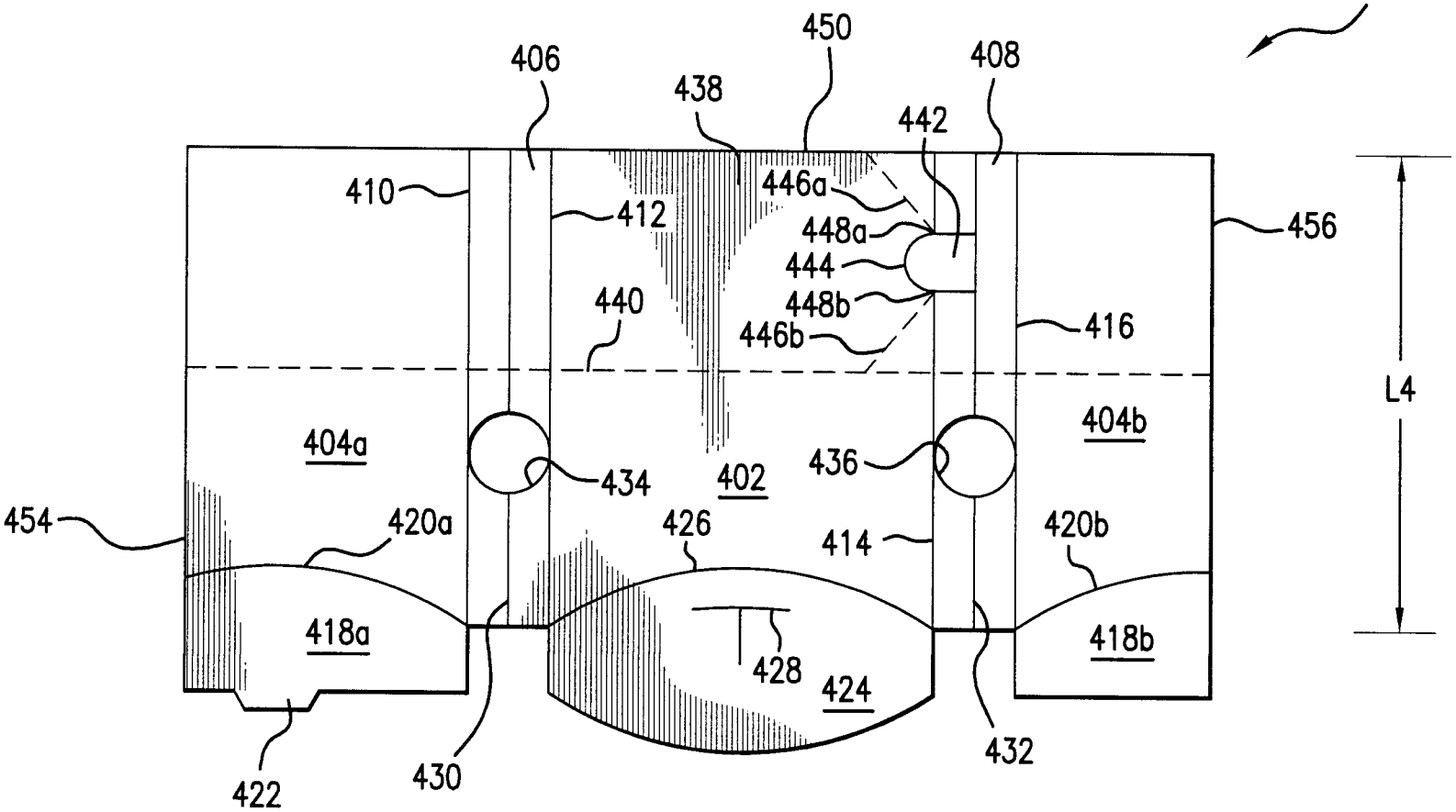
FIG. 4A depicts still another exemplary blank according to various aspects of the present invention.

FIG. 4A illustrates yet another exemplary blank 400 according to the invention. The blank 400 includes a plurality of panels including a main panel 402, a first major panel 404*a*, a second major panel 404*b*, a first minor panel 406, and a second minor panel 408 joined along various longitudinal fold lines 410, 412, 414, and 416, as shown. In this example, minor panels 406 and 408 are substantially equal in length, L4. Additionally, fold lines 410, 412, 414, and 416 are substantially parallel and substantially equal in length, L4. However, other lengths and configurations are contemplated hereby.

The blank 400 includes partial end panels 418*a* and 418*b* respectively joined to panels 404*a* and 404*b* along respective curved fold line segments 420*a* and 420*b*. Optionally, partial end panel 418*a* includes a locking feature 422. The blank 400 includes an end panel 424 joined to the main panel 402 along a somewhat arcuate fold line 426. In this example, the end panel 424 is substantially lentiform in shape. However, the end panel may have any suitable shape. End panel 424 includes a somewhat T-shaped receiving slit 428 substantially centered thereon and configured to receive locking feature 422.

The first minor panel 406 and the second minor panel 408 each include respective longitudinal fold lines 430 and 432 substantially centrally disposed and extending along the length L4 thereof. Optionally, one or both of the first minor panel 406 and the second minor panel 408 include respective apertures 434 and 436. In the example shown in FIG. 4, aperture 434 is substantially circular in shape and extends substantially between fold lines 410 and 412. Aperture 436 is substantially circular in shape and extends substantially between longitudinal fold lines 414 and 416. However, as stated above, any number and configuration of apertures may be used.

Still viewing FIG. 4A, the blank 400 includes a removable portion 438 extending across and formed from least a portion of each of panels 402, 404*a*, 404*b*, 406, and 408. The removable portion 438 is joined to the remainder of panels 402, 404*a*, and 404*b* along a transverse tear line 440. It will be understood that while the exemplary blank 400 of FIG. 4 includes only one removable portion 438, any number of such portions or panels and any configuration of such panels may be used as desired.

The removable portion 438 includes a somewhat elongate cutout 442 in the first main panel 402 and the second minor panel 408 terminating proximate to fold line 432. The portion of cutout 442 in the first main panel 402 is somewhat semicircular in shape with an arcuate grasping edge 444. The portion of the cutout 442 in the second minor panel 408 is generally rectangular or square in shape. Tear line 446*a* extends from a first end 448*a* of grasping edge 444 towards, and may abut, edge 450. Tear line 446*b* extends from a second end 448*b* of grasping edge 444 in a direction towards, and may abut substantially, transverse tear line 440. Tear lines 446*a* and 446*b* cooperate with grasping edge 444 to facilitate removal of the removable portion 438 when the blank is formed into a sleeve or container (not shown).

Figure 4B:
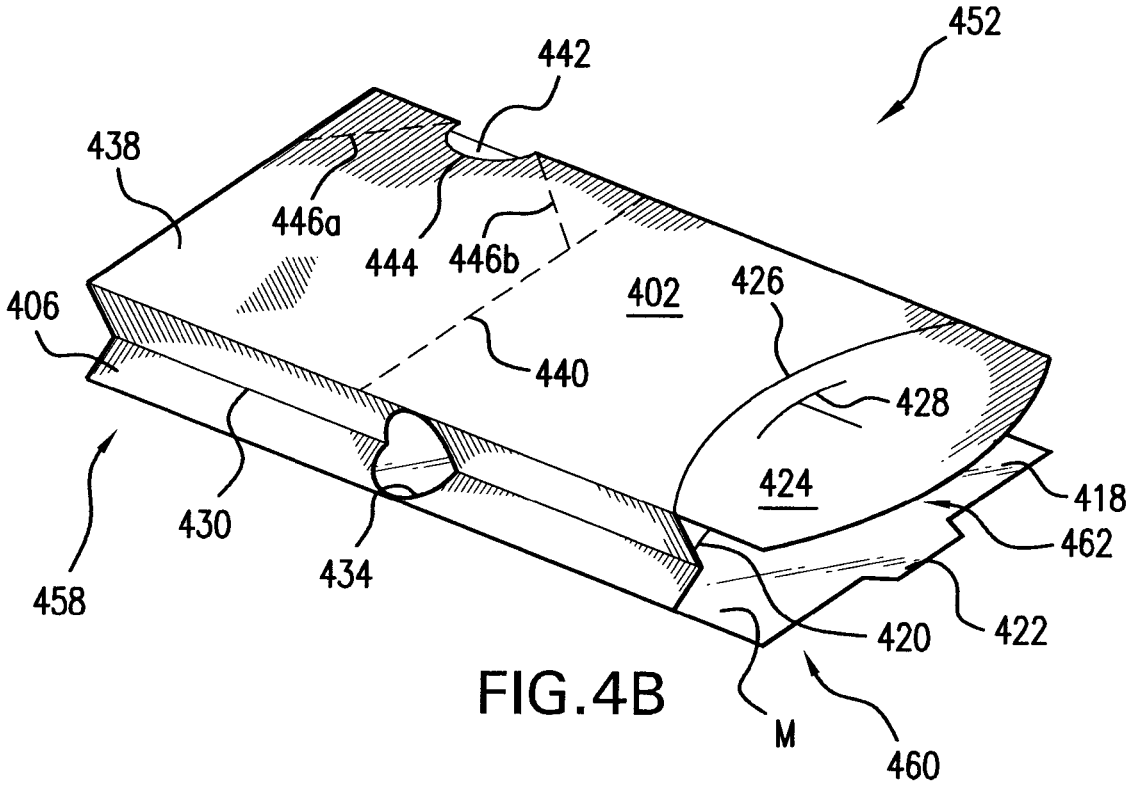
FIG. 4B illustrates the blank of FIG. 4A formed into a sleeve with two open ends, according to various aspects of the present invention.
Figure 4C:
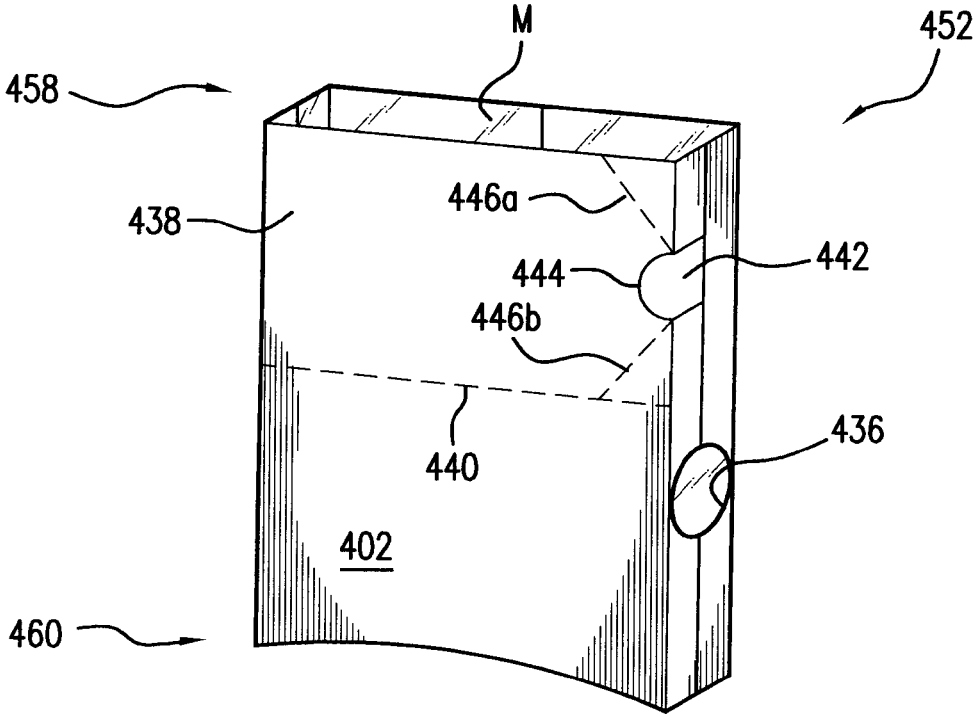
FIG. 4C illustrates the blank of FIG. 4A formed into a container for carrying a food item therein, according to various aspects of the present invention.

If desired, a susceptor M may overlie at least a portion of blank 400 (hidden from view in FIG. 4A, which illustrates the side of the blank that forms the exterior surface of the construct), and may form at least a portion of the interior surface of the construct 452 formed therefrom, as can be seen in FIGS. 4B and 4C.

Numerous sequences of steps may be used to form a sleeve or other construct 452 according to the invention. In one example, the blank 400 is folded along longitudinal fold lines 410, 412, 414, and 416, and edges 454 and 456 are brought towards each other to form a sleeve 452 having two open ends 458 and 460 and with a cavity or interior space 462 therebetween, as shown in FIG. 4B. The first and second major panels 404*a* and 404*b* are overlapped as needed to form a second main panel 404, partial end panels 418*a* and 418*b* are overlapped as needed to form end panel 418, and fold line segments 420*a* and 420*b* are overlapped as needed to form fold line 420. The overlapped portions may be glued or otherwise joined to form a sleeve 452 including a removable portion 438 comprising the removable portion 438 of the blank 400. The first minor panel 406 and second minor panel 408 form opposed side walls for the construct, which may be gusseted by folding inwardly along fold lines 430 and 432.

To use the construct 452, a food item (not shown) is inserted through an open end 458 or 460, and the construct with the food item inside is placed into a microwave oven (not shown) to be heated. As the food item is heated, the susceptor M enhances browning and/or crisping of the surface of the food item. Any steam generated during heating may be released through the open ends 458 and 460 of the sleeve, or through apertures 434 and 436.

After the item is heated sufficiently, the user may remove the food item from the sleeve 452 or may fold the end panels 418 and 424 towards the interior 462 of the sleeve 452 to form a construct having an open end 458 and a closed end 460, as shown in FIG. 4C. If desired, locking feature 422 may be inserted into receiving slit 428 to secure the panels in the locked position (hidden from view in FIG. 4C). When held in an upright position, the end panels 418 and 424 serve as a base for the container 452 to support a food item (not shown) therein.

As the food item is consumed, the construct may begin to interfere with accessing the food item. If desired, the user may insert a finger or other implement into cutout 442 along grasping edge 444 and begin to separate the removable portion 438 from the remainder of the construct. By doing so, the removable portion 438 will begin to separate from the remaining portions of the construct along tear lines 446*a*, 446*b*, and 440. Further pulling results in complete separation of the removable portion 438 from the construct, thereby allowing greater access to the food item therein, similar to that shown in connection with FIGS. 3D-3F.

Figure 5A:
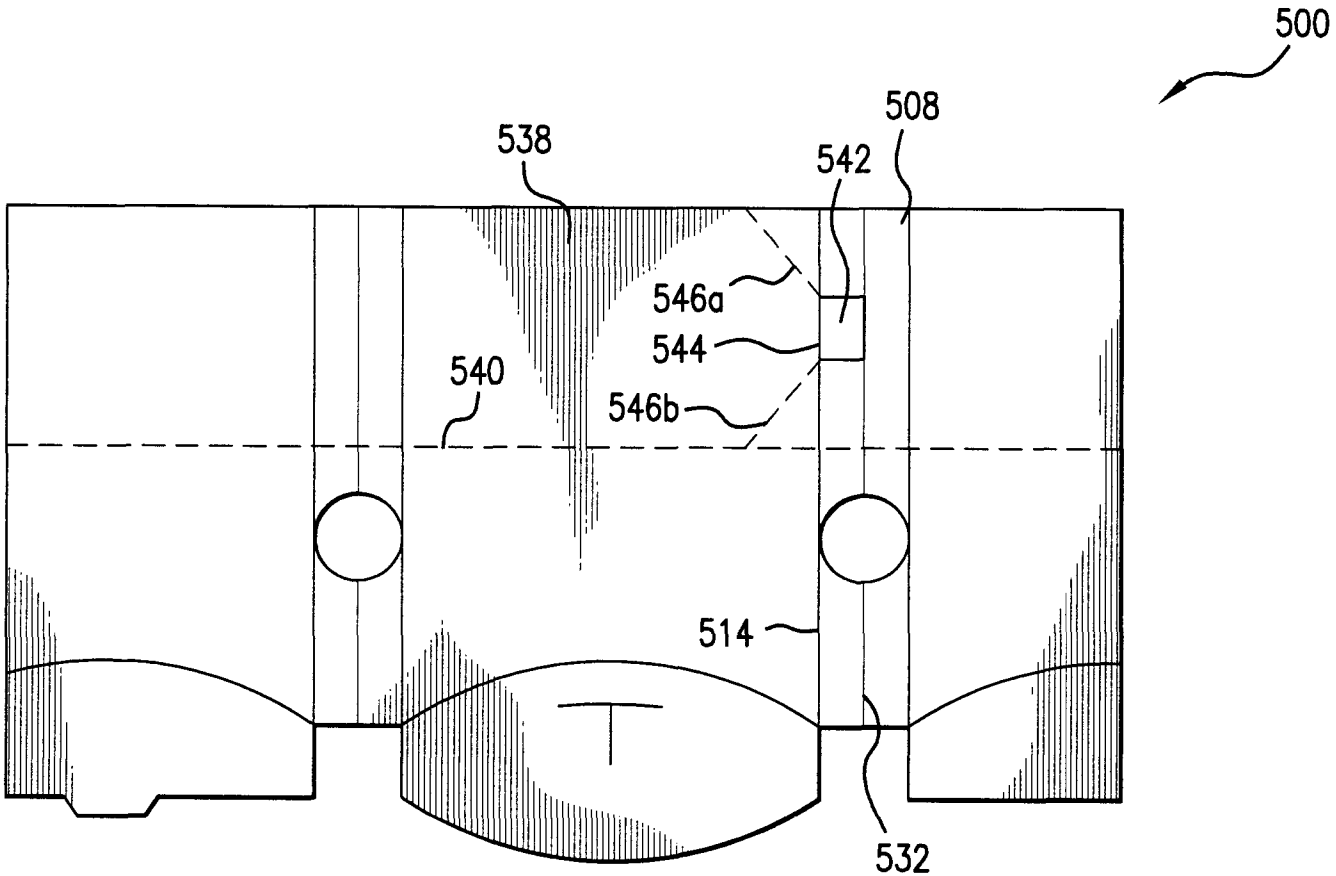
FIG. 5A depicts yet another exemplary blank according to various aspects of the present invention.

FIG. 5A illustrates still another exemplary blank 500 according to the invention. The blank of FIG. 5A is similar to the blank of FIG. 4A, except that cutout 502 lies within the second minor panel 508 and extends substantially between fold lines 514 and 532. The cutout 542 is somewhat square or rectangular in shape with a substantially straight grasping edge 544 substantially aligned with fold line 514.

Figure 5B:
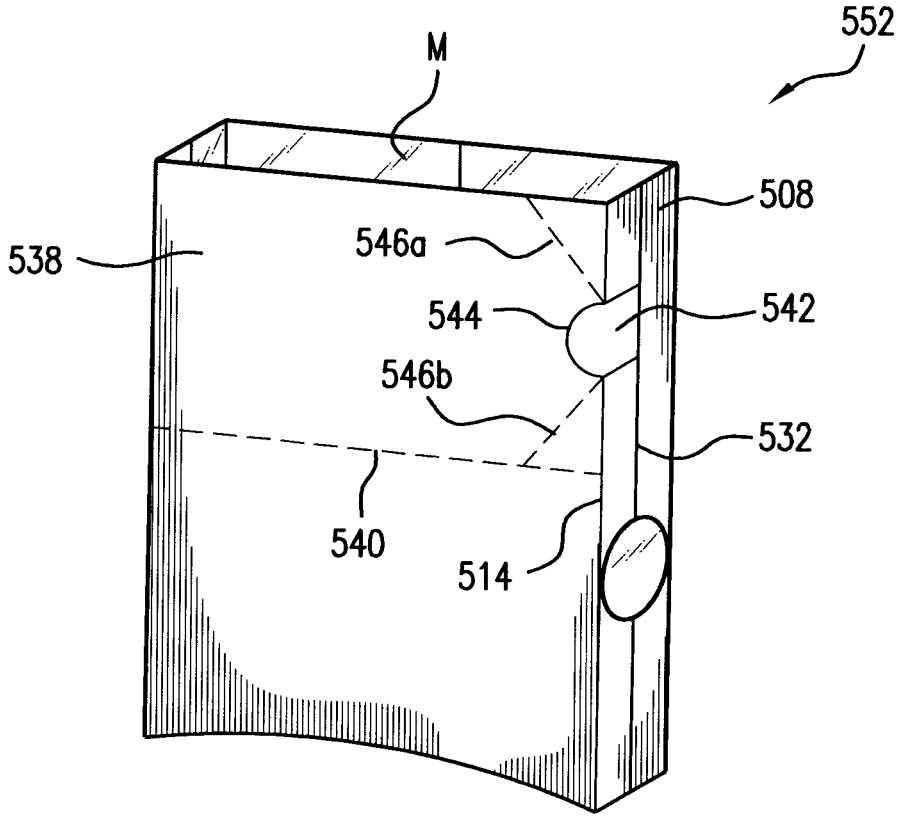
FIG. 5B illustrates the blank of FIG. 5A formed into a container for carrying a food item therein, according to various aspects of the present invention.

If desired, a susceptor M may overlie at least a portion of blank 500 (hidden from view in FIG. 5A, which illustrates the side of the blank that forms the exterior surface of the construct), and may form at least a portion of the interior surface of the construct 552 formed therefrom, as can be seen in FIG. 5B.

The blank 500 can be formed into a sleeve (not shown) for heating, browning, and/or crisping a food item in a microwave oven. The sleeve then can be transformed into a container for supporting the food item as it is consumed, as shown in FIG. 5B. The user may insert a finger or other implement into cutout 542 along grasping edge 544 and begin to separate the removable portion 538 from the remainder of the construct 552. By doing so, the removable portion 538 will begin to separate from the remaining portions of the construct along tear lines 546*a*, 546*b*, and 540. Further pulling results in complete separation of the removable portion 538 from the construct, thereby allowing greater access to the food item therein, similar to that shown in connection with FIGS. 3D-3F.

Figure 6A:
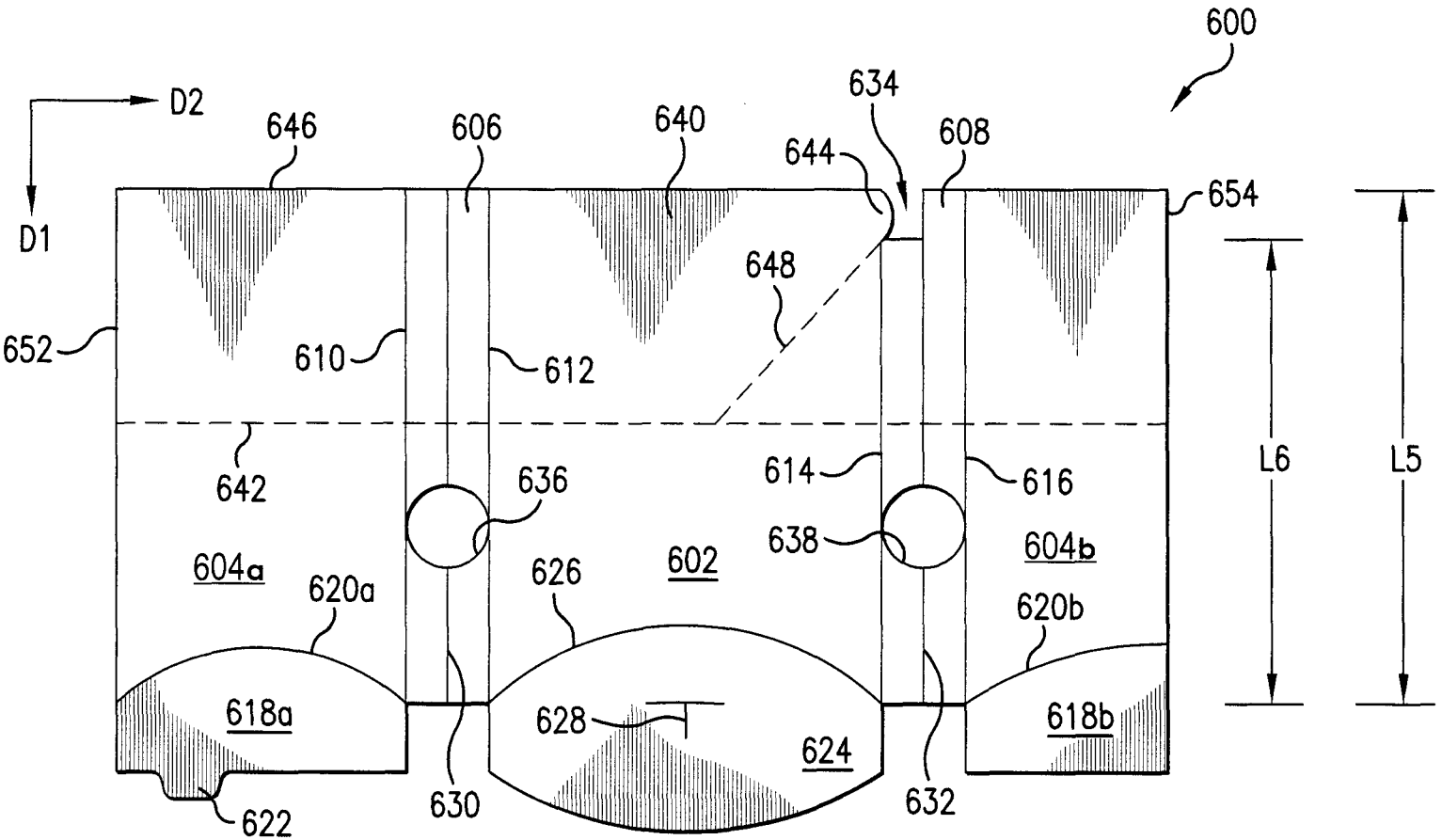
FIG. 6A depicts still another exemplary blank according to various aspects of the present invention.

FIG. 6A illustrates yet another exemplary blank 600 according to various aspects of the invention. The blank 600 includes a plurality of adjoined panels including a main panel 602, a first major panel 604*a*, a second major panel 604*b*, a first minor panel 606, and a second minor panel 608. The first minor panel 606 is joined to first major panel 604*a* along a longitudinal fold line 610. The main panel 602 is joined to the first minor panel 606 along a longitudinal fold line 612. The second minor panel 608 is joined to the main panel 602 along a longitudinal fold line 614. The second major panel 604*b* is joined to the second minor panel 608 along a longitudinal fold line 616. Fold lines 610, 612, and 616 are substantially parallel and substantially equal in length, as indicated by L5.

Fold line 614 is substantially parallel to fold lines 610, 612, and 616, but is somewhat shorter in length, as indicated by L6.

The blank 600 includes partial end panels 618*a* and 618*b* respectively joined to panels 604*a* and 604*b* along respective curved fold line segments 620*a* and 620*b*. Optionally, partial end panel 618*a* includes a tab or other locking feature 622. The blank 600 also includes an end panel 624 joined to the main panel 602 along a somewhat arcuate fold line 626. In this example, the end panel 624 is substantially lentiform in shape. However, any shape may be used. End panel 624 includes a somewhat T-shaped slit 628 substantially centered thereon and configured to receive locking feature 622.

If desired, one or both of the first minor panel 606 and the second minor panel 608 may include a substantially centrally located longitudinal fold line 630 and 632, respectively. Fold line 630 substantially bisects minor panel 606 into two similarly dimensioned segments, each having a length L5. Fold line 632 substantially bisects minor panel 608 into two segments of approximately equal width, but with differing lengths, L5 and L6, thereby defining a cutout 634. The length of minor panel 606 is approximately equal to the length of the portion of minor panel 608 that lies between fold line 632 and fold line 616. Optionally, one or both of the first minor panel 606 and the second minor panel 608 include respective apertures 636 and 638. In the example shown in FIG. 6A, aperture 636 is substantially circular in shape and extends between fold lines 610 and 612. Aperture 638 is substantially circular in shape and extends between longitudinal fold lines 614 and 616. However, any number and configuration of apertures may be used.

Still viewing FIG. 6A, the blank 600 includes a removable portion 640 extending across and formed from least a portion of each of panels 602, 604*a*, 604*b*, 606, and 608. The removable portion 640 is joined to the remainder of panels 602, 604*a*, and 604*b* along a transverse tear line 642. The removable portion 640 includes a somewhat rounded extension or tab 644 extending from the main panel 602 adjacent to peripheral edge 646 of the blank 600. An oblique tear line 648 extends from the tab 644 towards, and may abut, tear line 642. It will be understood that while the exemplary blank 600 of FIG. 6A includes only one removable portion 640, any number of such portions or panels and any configuration of such panels may be used as desired.

Figure 6B:
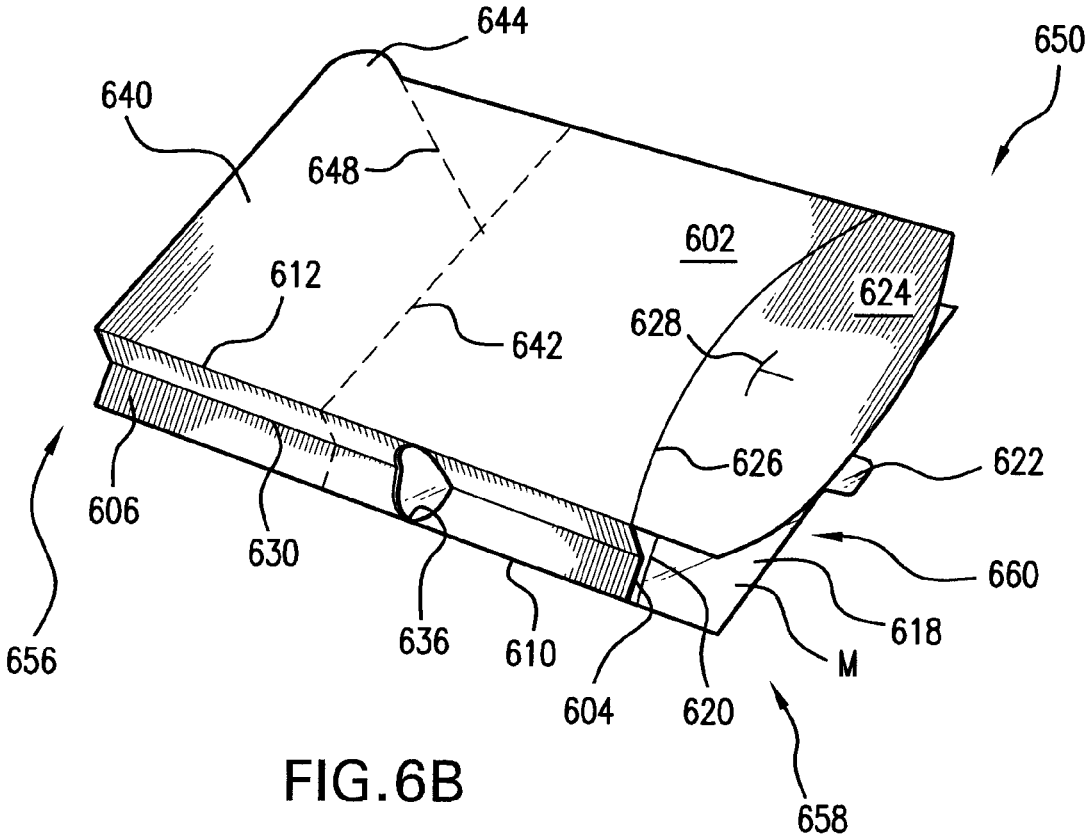
FIG. 6B illustrates the blank of FIG. 6A formed into a sleeve with two open ends, according to various aspects of the present invention.
Figure 6C:
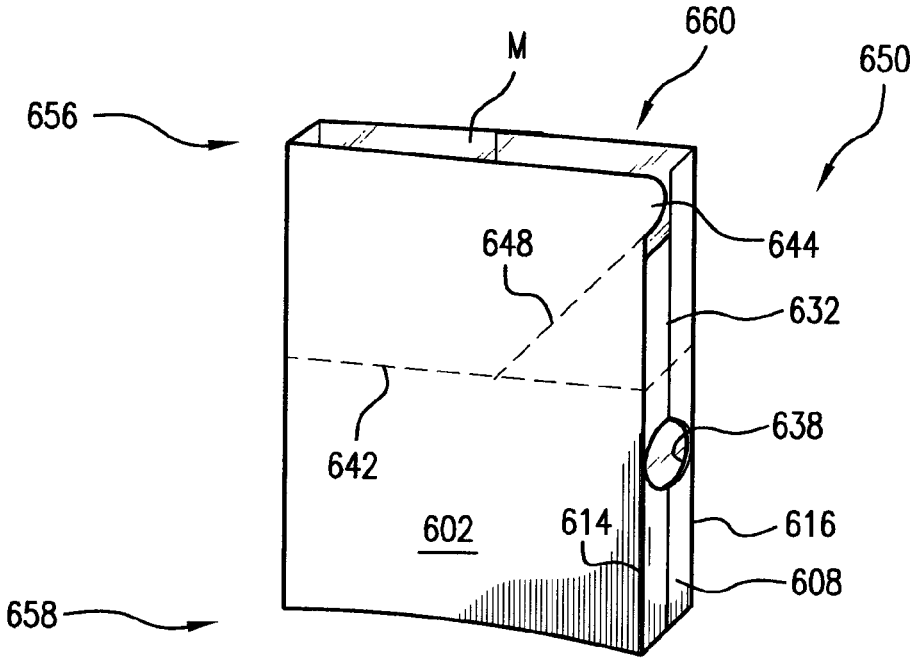
FIGS. 6C and 6D illustrate the blank of FIG. 6A formed into a container for carrying a food item therein, according to various aspects of the present invention
Figure 6D:
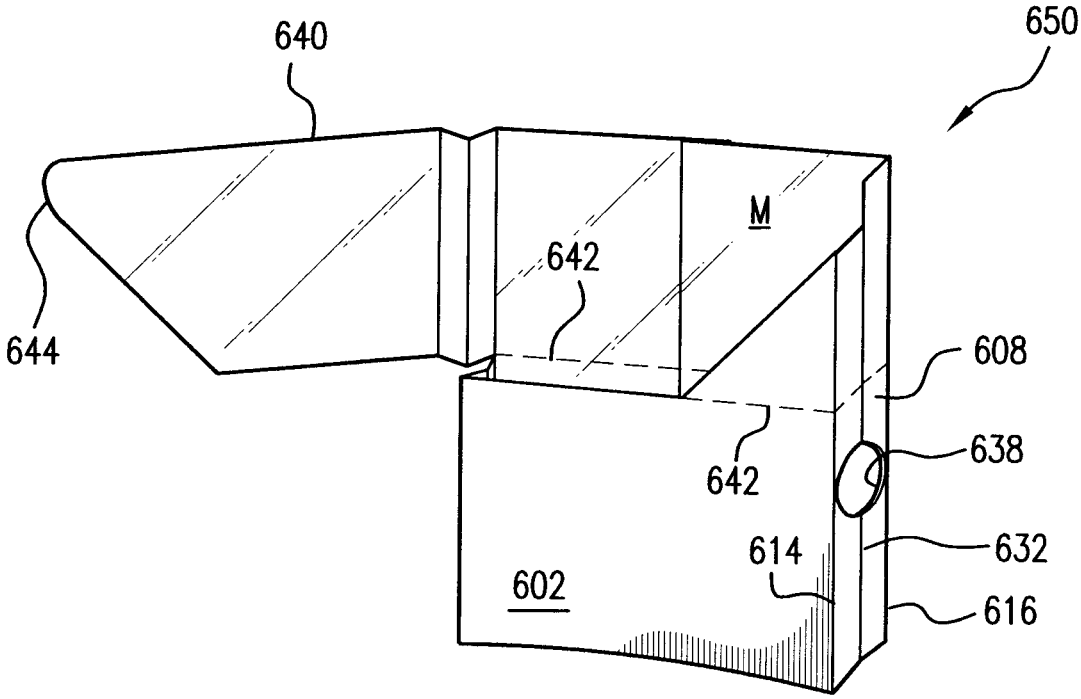

If desired, a susceptor M may overlie at least a portion of blank 600 (hidden from view in FIG. 6A, which illustrates the side of the blank that forms the exterior surface of the construct), and may form at least a portion of the interior surface of the construct 650 formed therefrom, as can be seen in FIG. 6B-6D.

Numerous sequences of steps may be used to form a sleeve or other construct 650 according to the invention. In one example, the blank 600 is folded along longitudinal fold lines 610, 612, 614, and 616, and edges 652 and 654 are brought towards each other to form a sleeve 648 having two open ends 656 and 658 with a cavity or interior space 660 therebetween, as shown in FIGS. 6B and 6C. The first and second major panels 604*a* and 604*b* are overlapped as needed to form a second main panel 604, partial end panels 618*a* and 618*b* are overlapped as needed to form end panel 618, and fold line segments 620*a* and 620*b* are overlapped as needed to form fold line 620. The overlapped portions may be glued or otherwise joined to form a sleeve 650 including a removable portion 640 comprising the removable portion 640 of the blank 600. The first minor panel 606 and second minor panel 608 form opposed side walls for the construct, which may be gusseted by folding inwardly along fold lines 630 and 632 (FIG. 6B).

The sleeve 650 may be used in a manner described above with respect to the various other examples provided herein. After heating, end panels 618 and 624 may be folded inwardly, and tab 622 may be inserted into slit 628 to secure the panels 618 and 624 in a locked configuration. In this manner, a food item (not shown) can be supported more securely when the container 650 is positioned in an upright configuration with the food item resting on the overlapped panels 618 and 624.

As shown in FIG. 6D, the removable portion 640 may be separated from the container 650 along tear lines 648 and 642 as needed to gain access to a food item (not shown) therein, as described above in connection with various other exemplary embodiments of the invention.

Figure 7A:
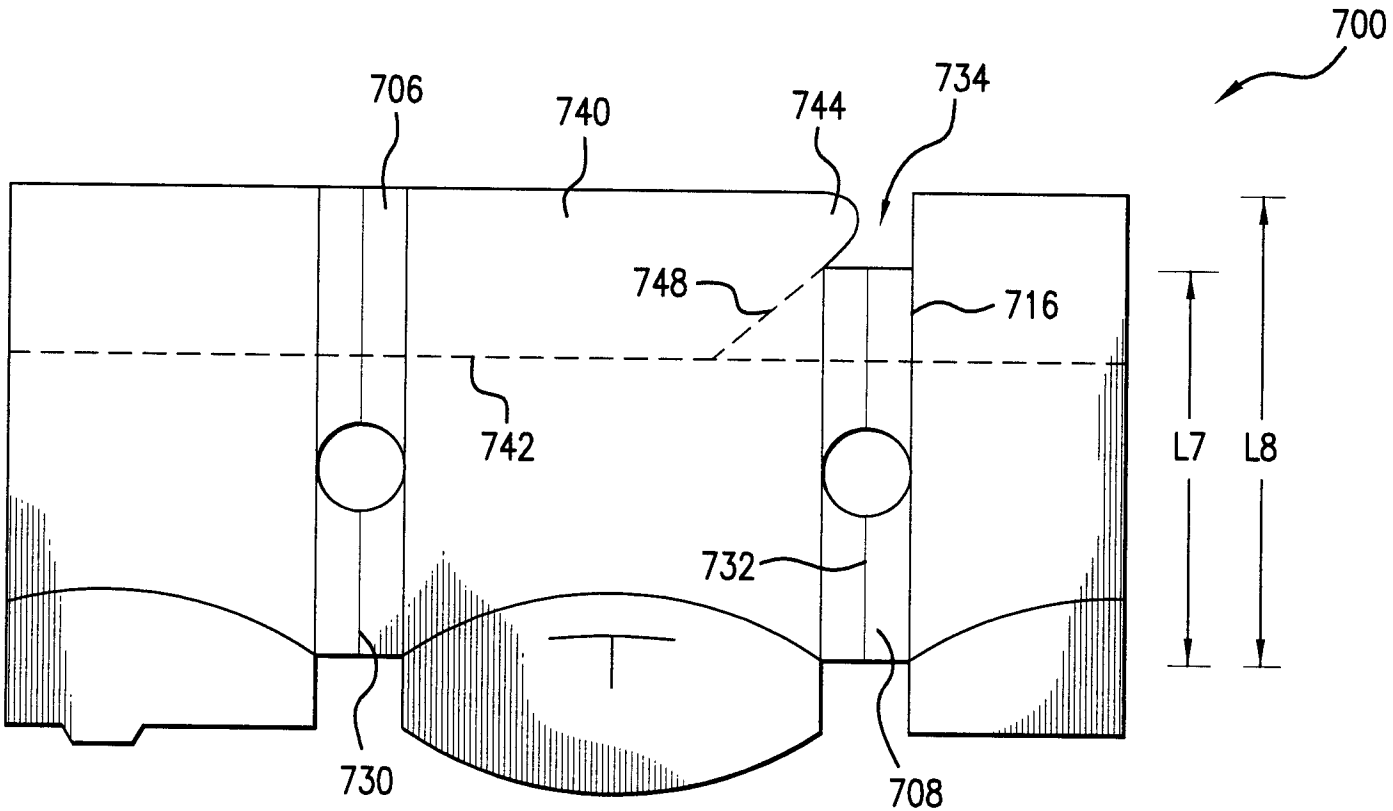
FIG. 7A depicts another exemplary blank according to various aspects of the present invention.

FIG. 7A illustrates still another exemplary blank 700 according to the invention. The blank of FIG. 7A is similar to the blank of FIG. 6A, except that longitudinal fold line 732 substantially bisects minor panel 708 into two similarly dimensioned segments, each having a length L7, such that cutout 734 extends substantially between tab 744 and fold line 716. Thus, minor panel 708 has an overall length L7 that is less than the length L8 of minor panel 706. Likewise, fold line 732 has a length L7 that is less than the length L8 of fold line 730.

Figure 7B:
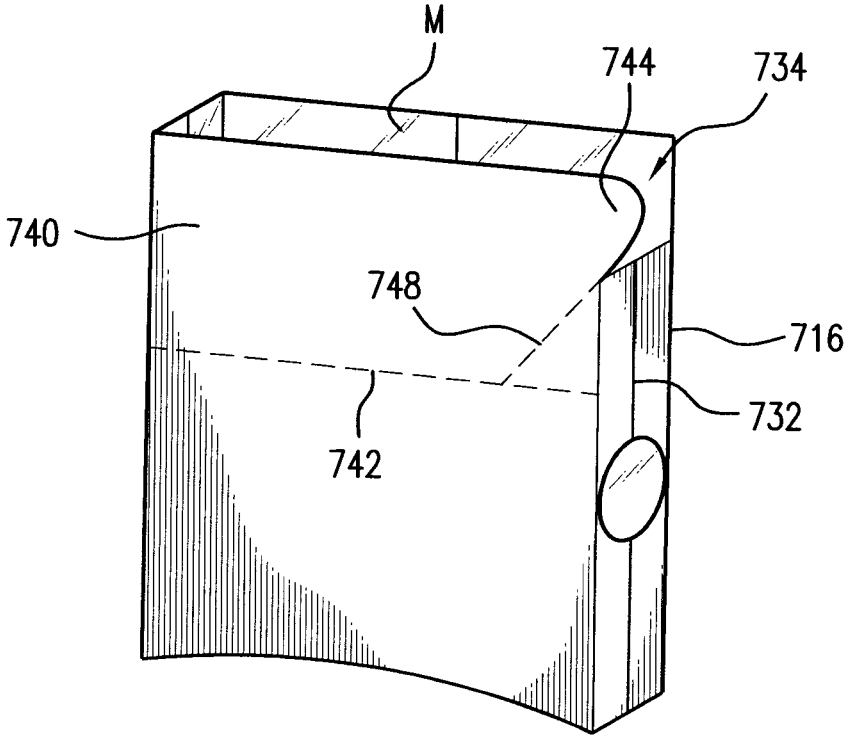
FIG. 7B illustrates the blank of FIG. 7A formed into a container for carrying a food item therein, according to various aspects of the present invention.

If desired, a susceptor M may overlie at least a portion of blank 700 (hidden from view in FIG. 7A, which illustrates the side of the blank that forms the exterior surface of the construct), and may form at least a portion of the interior surface of the construct 750 formed therefrom, as can be seen in FIG. 7B.

The blank 700 can be formed into a sleeve (not shown) for heating, browning, and/or crisping a food item in a microwave oven. The sleeve then can be transformed into a container for supporting the food item (not shown) as it is consumed, as shown in FIG. 7B. If needed, the removable portion 740 may be separated from the remainder of the container 750 along tear lines 748 and 742 as needed to gain access to the food item, as described above in connection with various other exemplary embodiments of the invention.

In the examples shown herein, the construct is somewhat rectangular in shape, suitable, for example, for heating a sandwich or breakfast pastry therein. However, it will be understood that in this and other aspects of the invention described herein or contemplated hereby, numerous suitable shapes and configurations may be used to form the various panels and, therefore, constructs. Examples of other shapes encompassed hereby include, but are not limited to, polygons, circles, ovals, cylinders, prisms, spheres, polyhedrons, and ellipsoids. The shape of each panel may be determined largely by the shape of the food item, and it should be understood that different packages are contemplated for different food items, for example, sandwiches, pizzas, French fries, soft pretzels, pizza bites, cheese sticks, pastries, doughs, and so forth. The construct may be flexible, semi-rigid, rigid, or may include a variety of components having different degrees of flexibility. Likewise, the construct may include gussets, pleats, or any other feature needed or desired to accommodate a particular food item and/or portion size. Additionally, it will be understood that the present invention contemplates blanks and constructs for single-serving portions and for multiple-serving portions.

Although certain embodiments of this invention have been described with a certain degree of particularity, those skilled in the art could make numerous alterations to the disclosed embodiments without departing from the spirit or scope of this invention. All directional references (e.g., upper, lower, upward, downward, left, right, leftward, rightward, top, bottom, above, below, vertical, horizontal, clockwise, and counterclockwise) are used only for identification purposes to aid the reader's understanding of the various embodiments of the present invention, and do not create limitations, particularly as to the position, orientation, or use of the invention unless specifically set forth in the claims. Joinder references (e.g., joined, attached, coupled, connected, and the like) are to be construed broadly and may include intermediate members between a connection of elements and relative movement between elements. As such, joinder references do not necessarily imply that two elements are connected directly and in fixed relation to each other.

It will be understood that in each of the various blanks and trays described herein and contemplated hereby, a "fold line" can be any substantially linear, although not necessarily straight, form of weakening that facilitates folding therealong. More specifically, but not for the purpose of narrowing the scope of the present invention, a fold line may be a score line, such as lines formed with a blunt scoring knife, or the like, which creates a crushed portion in the material along the desired line of weakness, a cut that extends partially into a material along the desired line of weakness, and/or a series of cuts that extend partially into and/or completely through the material along the desired line of weakness; or any combination of these features.

For example, one type of conventional tear line is in the form of a series of cuts that extend completely through the material, with adjacent cuts being spaced apart slightly so that a nick (e.g., a small somewhat bridging-like piece of the material) is defined between the adjacent cuts for typically temporarily connecting the material across the tear line. The nicks are broken during tearing along the tear line. Such a tear line that includes nicks can also be referred to as a cut line, since the nicks typically are a relatively small percentage of the subject line, and alternatively the nicks can be omitted from such a cut line.

Furthermore, various exemplary blanks and constructs are shown and described herein as having fold lines, tear lines, score lines, cut lines, kiss cut lines, and other lines as extending from a particular feature to another particular feature, for example from one particular panel to another, from one particular edge to another, or any combination thereof. However, it will be understood that such lines need not necessarily extend between such features in a precise manner. Instead, such lines may generally extend between the various features as needed to achieve the objective of such line. For instance, where a particular tear line is shown as extending from a first edge of a blank to another edge of the blank, the tear line need not extend completely to one or both of such edges. Rather, the tear line need only extend to a location sufficiently proximate to the edge so that the removable strip, panel, or portion can be manually separated from the blank or construct without causing undesirable damage thereto.

Accordingly, it will be readily understood by those persons skilled in the art that, in view of the above detailed description of the invention, the present invention is susceptible of broad utility and application. Many adaptations of the present invention other than those herein described, as well as many variations, modifications, and equivalent arrangements will be apparent from or reasonably suggested by the present invention and the above detailed description thereof, without departing from the substance or scope of the invention as set forth in the following claims.

While the present invention is described herein in detail in relation to specific aspects, it is to be understood that this detailed description is only illustrative and exemplary of the present invention and is made merely for purposes of providing a full and enabling disclosure of the present invention and to provide the best mode contemplated by the inventor or inventors of carrying out the invention. The detailed description set forth herein is not intended nor is to be construed to limit the present invention or otherwise to exclude any such other embodiments, adaptations, variations, modifications, and equivalent arrangements of the present invention.

What is claimed is:

1. A blank for forming a microwave heating construct, comprising:

a plurality of adjoined panels, each panel having a first dimension extending in a first direction and a second dimension extending in a second direction substantially perpendicular to the first direction, at least one panel of the plurality of adjoined panels including microwave energy interactive material, wherein the plurality of adjoined panels define a plurality of peripheral edges of the blank including a first peripheral edge extending in the second direction, the plurality of adjoined panels includes a first panel and a second panel joined to one another along a fold line extending in the first direction, and the blank includes a removable portion defined at least partially by a transverse tear line extending in the second direction substantially across the adjoined panels, a cut initiating and terminating substantially along the fold line, a first tear line extending obliquely from the cut to the transverse tear line, and a second tear line extending obliquely from the cut to the first peripheral edge of the blank, such that the removable portion of the blank includes the first peripheral edge of the blank.

2. The blank of claim 1, wherein the transverse fold line is substantially centered along the first dimension of the first panel.

3. The blank of claim 1, wherein the cut interrupts the fold line joining the first panel and the second panel.

4. The blank of claim 1, wherein the cut is substantially centered along the first dimension of the removable portion of the blank.

5. The blank of claim 1, wherein the cut is disposed distal from the first peripheral edge.

6. The blank of claim 1, wherein the first tear line and the second tear line extend convergently towards the cut.

7. The blank of claim 1, wherein the fold line is a first fold line, the second panel includes a second fold line extending in the second direction, and the cut is disposed between the first fold line and the second fold line.

8. The blank of claim 7, wherein the cut is spaced from the second fold line.

9. The blank of claim 1, wherein the fold line is a first fold line, and the plurality of adjoined panels further includes a third panel joined to the first panel along a second fold line extending in the first direction, a fourth panel joined to the third panel along a third fold line extending in the first direction, and a fifth panel joined to the second panel along a fourth fold line extending in the first direction, wherein the second panel and the third panel each have a second dimension that is less than the second dimension of each of the first panel, fourth panel, and fifth panel.

10. The blank of claim 9, wherein the plurality of adjoined panels further includes an end panel joined to the first panel along a substantially arcuate fold line, a first partial end panel joined to the fourth panel along a first curved fold line, and a second partial end panel joined to the fifth panel along a second curved fold line.

11. The blank of claim 1, wherein the microwave energy interactive material is operative for converting at least a portion of impinging microwave energy into thermal energy.

12. A construct for heating, browning, and/or crisping a food item therein, comprising:

a first main panel and a second main panel opposite one another; and a first minor panel and a second minor panel opposite one another, the first main panel, second main panel, first minor panel, and second minor panel each including a first end defining an opening at a first end of the construct, wherein the construct includes a removable portion including the first end of each of the first main panel, the second main panel, the first minor panel, and the second minor panel defining the opening at the first end of the construct, the removable portion being defined at least partially by a transverse tear line extending across the first main panel and second main panel, and optionally, at least one of the first minor panel and second minor panel, a tab extending from a fold line joining the first main panel and the first minor panel, wherein the tab interrupts the first fold line, a first tear line extending obliquely from the tab to the transverse tear line, and a second tear line extending obliquely from the tab to the opening, and wherein the first main panel and second main panel, and optionally, at least one of the first minor panel and second minor panel, include microwave energy interactive material.

13. The construct of claim 12, wherein the fold line joining the first main panel and the first minor panel comprises a side edge of the first main panel, so that the tab extends from the side edge of the first main panel.

14. The construct of claim 12, further comprising an aperture in the first minor panel adjacent to the fold line joining the first main panel and the first minor panel, the aperture being defined by striking the tab from the minor panel.

15. The construct of claim 12, wherein the tab is substantially centered along a length of the removable portion of the construct, the length of the removable portion being defined as a distance from the opening to the transverse tear line.

16. The construct of claim 12, wherein the first tear line and the second tear line extend convergently towards the tab.

17. The construct of claim 12, further comprising a first end panel foldably joined to a second end of the first main panel opposite the first end of the first main panel, and a second end panel foldably joined to a second end of the second main panel opposite the first end of the second main panel, wherein the first end panel and the second end panel are in a substantially opposed, facing relationship.

18. The construct of claim 17, wherein the first end panel and the second end panel are foldably joined to the first main panel and the second main panel along respective arcuate fold lines.

19. The construct of claim 17, wherein the first end panel and the second end panel are operative for being folded towards one another.

20. The construct of claim 12, wherein the microwave energy interactive material is operative for converting at least a portion of impinging microwave energy into heat.

21. The blank of claim 1, wherein the cut is arcuate in shape.

22. The blank of claim 1, wherein the cut defines a tab adjacent to the fold line.

23. A microwave heating construct, comprising:

a first main panel and a second main panel opposite one another; and a first minor panel and a second minor panel opposite one another, the first main panel, second main panel, first minor panel, and second minor panel each including a first end defining an open end of the construct, and a second end opposite the first end, wherein the construct includes a removable portion adjacent to the open end of the construct, the removable portion being defined at least partially by a tab extending from a side edge of the first main panel, wherein the side edge of the first main panel extends from the first end of the first main panel to the second end of the first main panel, a first tear line extending across the first main panel, and optionally, at least one of the second main panel, first minor panel, and second minor panel, a second tear line extending from the tab to the transverse tear line, and a third tear line extending from the tab to the opening, wherein the construct includes microwave energy interactive material operative for converting microwave energy into heat.

24. The construct of claim 23, wherein the tab is substantially coplanar with the first main panel.

25. The construct of claim 23, further comprising an aperture positioned between the first minor panel and the tab.

26. The construct of claim 23, wherein the tab is substantially centered between the open end of the construct and the first tear line.

27. The construct of claim 23, wherein the second tear line and the third tear line extend divergently away from the tab.

28. The construct of claim 23, further comprising a pair of end panels foldably joined to the first main panel and second main panel.

* * * * *